US009126399B2

(12) United States Patent
Hirano et al.

(10) Patent No.: US 9,126,399 B2
(45) **Date of Patent: *Sep. 8, 2015**

(54) INK SUPPLY METHOD AND INK SUPPLY APPARATUS

(71) Applicants: Masahiro Hirano, Ibaraki (JP); Keiichi Hosaki, Ibaraki (JP)

(72) Inventors: Masahiro Hirano, Ibaraki (JP); Keiichi Hosaki, Ibaraki (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/077,106

(22) Filed: Nov. 11, 2013

(65) Prior Publication Data

US 2014/0130689 A1 May 15, 2014

(30) Foreign Application Priority Data

Nov. 12, 2012 (JP) ..... 2012-248138

(51) Int. Cl.

| | |
|---|---|
| ***B41F 31/20*** | (2006.01) |
| ***B41F 31/02*** | (2006.01) |
| ***B41F 31/04*** | (2006.01) |
| ***B41F 31/30*** | (2006.01) |

(Continued)

(52) U.S. Cl.

CPC ..... *B41F 31/027* (2013.01); *B41F 31/045* (2013.01); *B41F 31/301* (2013.01); *B41F 33/08* (2013.01); *B41F 33/10* (2013.01); *B41P 2233/11* (2013.01)

(58) Field of Classification Search

CPC ..... B41F 31/301; B41F 31/302; B41F 31/10; B41F 31/045; B41F 31/20; B41F 33/0045; B41F 35/04; B41P 2233/11

USPC ..... 101/351.1–351.4, 352.01–352.05, 365, 101/425, 484, DIG. 47

See application file for complete search history.

(56) References Cited

U.S. PATENT DOCUMENTS 3,701,316 A * 10/1972 Sylvester et al. ..... 101/148
4,882,991 A * 11/1989 Simeth ..... 101/350.2

(Continued)

FOREIGN PATENT DOCUMENTS

CN 102991119 A 3/2013
CN 102991120 A 3/2013

(Continued)

OTHER PUBLICATIONS

Chinese Office Action (Application No. 201310556702.3) with English translation, Apr. 9, 2015.

*Primary Examiner* — Daniel J Colilla
*Assistant Examiner* — Leo T Hinze
(74) *Attorney, Agent, or Firm* — Blakely Sokoloff Taylor & Zafman

(57) ABSTRACT

In an ink supply method in an ink supply apparatus including an ink fountain storing, a plurality of ink fountain keys, an ink fountain roller, an ink ductor roller, and an ink roller group, the throw-off operation of an ink form roller positioned at the end of the ink roller group is performed after the end of a print job using a preceding printing plate. The ink feed operation of the ink ductor roller is stopped after the end of the print job using the preceding printing plate. The ink roller group is divided into a plurality of roller subgroups after the end of the print job using the preceding printing plate. The ink in some roller subgroups out of the divided roller subgroups is scraped and removed by an ink scraping member. An ink supply apparatus is also disclosed.

5 Claims, 26 Drawing Sheets

(51) Int. Cl.

| | |
|---|---|
| ***B41F 33/10*** | (2006.01) |
| ***B41F 33/08*** | (2006.01) |

(56) References Cited

U.S. PATENT DOCUMENTS

| | | | | |
|---|---|---|---|---|
| 5,174,210 | A | 12/1992 | Rodi et al. | |
| 5,365,849 | A * | 11/1994 | Spiegel | 101/423 |
| 6,116,161 | A * | 9/2000 | Voge et al. | 101/483 |
| 6,615,728 | B2 * | 9/2003 | Kurata et al. | 101/484 |
| 6,712,002 | B2 * | 3/2004 | Herbst et al. | 101/351.1 |
| 8,201,903 | B2 * | 6/2012 | Hirano | 347/7 |
| 2007/0022888 | A1 * | 2/2007 | Inde et al. | 101/365 |
| 2013/0061768 | A1 | 3/2013 | Hirano et al. | |
| 2013/0061769 | A1 | 3/2013 | Hirano et al. | |

FOREIGN PATENT DOCUMENTS

| | | | |
|---|---|---|---|
| EP | 2 284 008 | A1 | 2/2001 |
| EP | 2 567 818 | A2 | 3/2013 |
| JP | S58-201008 | A | 11/1983 |
| JP | S58-201010 | A | 11/1983 |
| JP | H03-097564 | A | 4/1991 |
| JP | H10-016193 | A | 1/1998 |
| JP | H11-188844 | A | 7/1999 |

* cited by examiner

DIVISION
COUPLING
REDIVISION
RECOUPLING
Mc
McA
McB
McB'
Md
MdA
MdB
MdB'
Me
INK ROLLER GROUP
PLATE CYLINDER/ BLANKET CYLINDER
THROW-OFF
PLATE REPLACEMENT/ CLEANING
PRE-INKING IN INK APPARATUS
THROW-ON
PLATE CYLINDER/ BLANKET CYLINDER PRE-INKING

DIVISION

COUPLING

Mc
McA
McB
McB'
McB'
Md
Md
Md'
Me
INK ROLLER GROUP
PLATE CYLINDER/ BLANKET CYLINDER
THROW-OFF
PLATE REPLACEMENT/ CLEANING
PRE-INKING IN INK APPARATUS
THROW-ON
PLATE CYLINDER/ BLANKET CYLINDER PRE-INKING

INK SUPPLY METHOD AND INK SUPPLY APPARATUS

BACKGROUND OF THE INVENTION

The present invention relates to an ink supply method and apparatus for supplying ink supplied to an ink fountain roller to a printing plate mounted on a plate cylinder via an ink roller group by the ink feed operation of an ink ductor roller.

FIG. 15 shows the main part of an inker (ink supply apparatus) in a printing unit of each color in a web offset printing press. In FIG. 15, the inker includes an ink fountain 1, an ink 2 stored in the ink fountain 1, an ink fountain roller 3, a plurality of ink fountain keys 4 (4-1 to **4-*n*) juxtaposed in the axial direction of the ink fountain roller 3, an ink ductor roller 5, an ink roller group 6, a printing plate 7, a plate cylinder 8 on which the printing plate 7 is mounted, a blanket cylinder 9, and an impression cylinder 50. The ink fountain 1, ink fountain roller 3, ink fountain keys 4, ink ductor roller 5, and ink roller group 6 form an ink supply path for supplying ink in the ink fountain 1 to the printing plate 7**.

In the ink supply apparatus, the ink 2 in the ink fountain 1 is supplied to the ink fountain roller 3 by adjusting the opening degrees of the ink fountain keys 4-1 to **4-*n*. The ink supplied to the ink fountain roller 3 is supplied to the printing plate 7 via the ink roller group 6 by the ink feed operation of the ink ductor roller 5**.

An image is printed on the printing plate 7. The blanket cylinder 9 receives the ink supplied to the printing plate 7, and the ink received by the blanket cylinder 9 is transferred to a printing sheet (member to be printed) 51 fed between the blanket cylinder 9 and the impression cylinder 50.

Note that ink form rollers 6-1 to 6-4 in contact with the printing plate 7 are arranged at the end of the ink flow path of the ink roller group 6. Dampening water stored in a water pan 53 is supplied to the printing plate 7 via a form dampening roller 52 together with the ink via the ink form rollers 6-1 to 6-4.

When switching a print job in the ink supply apparatus, that is, when replacing the printing plate 7 for a preceding print job with a printing plate 7' for the next print job, the opening degrees of the ink fountain keys 4-1 to **4-*n*, the rotation amount of the ink fountain roller 3, and the like are changed to values corresponding to an image on the printing plate 7' for the next print job. The ink 2 in the ink fountain 1 is supplied to the replaced printing plate 7' via the ink roller group 6. In this case, test printing is performed before final printing to adjust the ink supply amount, obtaining a satisfactory color tone. As a result, a desired ink film thickness distribution (gradient of the ink film thickness) is formed in the ink roller group 6 and on the plate cylinder 8 and blanket cylinder 9**.

However, in a conventional ink supply apparatus, when the printing plate 7 is replaced with the printing plate 7' to execute the next print job, an ink film thickness distribution corresponding to the printing plate 7 for the preceding print job remains in the ink roller group 6. In this case, the ink film thickness distribution corresponding to the printing plate 7 for the preceding print job needs to be gradually changed to an ink film thickness distribution corresponding to the printing plate 7' for the next print job. Adjustment of the ink supply amount and test printing are required excessively until a satisfactory color tone is obtained. This causes problems such as "increase in pre-printing preparation time", "increase in work load", "waste of printing materials", "decrease in production efficiency", and "increase in cost".

To reduce adjustment of the ink supply amount and the test printing count until a satisfactory color tone is obtained, there have been proposed "ink film thickness control methods" disclosed in Japanese Patent Laid-Open No. 10-16193 (literature 1) and Japanese Patent Laid-Open No. 11-188844 (literature 2).

[Ink-Decrease+Pre-Inking 2]

In the ink film thickness control method described in literature 1, when switching a print job, the ink feed operation of the ink ductor roller 5 is stopped. While the printing plate 7 for the preceding print job remains mounted, the printing press is operated to print a predetermined number of sheets (blank sheet printing), decreasing ink in the ink supply apparatus (ink-decrease). A minimum ink film thickness distribution Ma (see FIG. 16A) which thins from the upstream side to downstream side of the ink roller group 6 and is required during printing, that is, an ink film thickness distribution Ma corresponding to an image-free portion of the printing plate 7 remains (ink removing).

Then, the opening degrees of the ink fountain keys 4-1 to **4-*n*, the rotation amount of the ink fountain roller 3, and the like are set to values corresponding to an image on the printing plate 7' for the next print job. While the ink form rollers 6-1 to 6-4 are thrown off, the printing press is operated to perform the ink feed operation of the ink ductor roller 5 by a predetermined number of times. An ink film thickness distribution Mb (see FIG. 16B) corresponding to the image on the printing plate 7' for the next print job is superposed on the minimum ink film thickness distribution Ma which remains in the ink roller group 6 and is required during printing (pre-inking 2**).

[Ink Return to Fountain+Pre-Inking 1]

In the ink film thickness control method described in literature 2, when switching a print job, the opening ratios of the ink fountain keys 4-1 to **4-*n* are set to 0. In this state, the ink feed operation of the ink ductor roller 5 is performed by a predetermined number of times, returning all ink remaining in the ink roller group 6 to the ink fountain 1 (ink return to fountain). As a result, each roller in the ink roller group 6** does not hold any ink.

The opening degrees of the ink fountain keys 4-1 to **4-*n* are set to a predetermined value (e.g., 50%), and the rotation amount of the ink fountain roller 3 is set to a predetermined value (e.g., 50%). Then, the ink feed operation of the ink ductor roller 5 is performed by a predetermined number of times, forming a minimum ink film thickness distribution Ma (see FIG. 16A) required during printing in the ink roller group 6 (first step of pre-inking 1**).

The opening degrees of the ink fountain keys 4-1 to **4-*n*, the rotation amount of the ink fountain roller 3, and the like are set to values corresponding to the image on the printing plate 7' for the next print job. While the ink form rollers 6-1 to 6-4 are thrown off, the printing press is operated to perform the ink feed operation of the ink ductor roller 5 by a predetermined number of times. An ink film thickness distribution Mb (see FIG. 16B) corresponding to the image on the printing plate 7' for the next print job is superposed on the minimum ink film thickness distribution Ma which is formed in the ink roller group 6 and required during printing (second step of pre-inking 1**).

However, the ink film thickness control method described in literature 1 wastes sheets because blank sheet printing is performed when leaving the ink film thickness distribution Ma on the ink roller group 6.

The ink film thickness control method described in literature 2 takes time because all ink on the ink roller group 6 is returned to the ink fountain 1, and a modified ink film thickness distribution (Ma+Mb) is formed from zero. In this method, since emulsified ink (ink kneaded with dampening water) is returned to the ink fountain 1, a printing trouble occurs, wasting printing materials.

SUMMARY OF THE INVENTION

The present invention has as its object to provide an ink supply method and ink supply apparatus capable of correcting an ink film thickness distribution formed in an ink roller group within a short time without performing blank sheet printing or "ink return to fountain" when replacing a printing plate and forming an ink film thickness distribution corresponding to an image on a printing plate to be used for printing of the next job.

In order to achieve the above-described object, according to the present invention, there is provided an ink supply method in an ink supply apparatus, comprising the steps of performing a throw-off operation of an ink form roller positioned at an end of an ink roller group after an end of a print job using a preceding printing plate, stopping an ink feed operation of an ink ductor roller after the end of the print job using the preceding printing plate, dividing the ink roller group into a plurality of roller subgroups after the end of the print job using the preceding printing plate, and scraping and removing an ink in some roller subgroups out of the divided roller subgroups by an ink scraping member.

Also, according to the present invention, there is provided an ink supply apparatus comprising disconnection means for disconnecting the ink roller group from an ink supply path extending from an ink fountain to a printing plate by, after an end of a print job using a preceding printing plate, performing a throw-off operation of an ink form roller positioned at an end of an ink roller group and stopping an ink feed operation of an ink ductor roller, division means for dividing the ink roller group into a plurality of roller subgroups after the end of the print job using the preceding printing plate, and an ink scraping member which scrapes the ink in some roller subgroups out of the plurality of roller subgroups divided by the division means.

According to the present invention, ink in some roller subgroups is scraped and removed by a blade, scraper, or the like. When switching a print job, an ink film thickness distribution corresponding to an image on a printing plate to be used for printing of the next job can be formed in the ink roller group within a short time without performing blank sheet printing or "ink return to fountain".

DESCRIPTION OF THE PREFERRED EMBODIMENT

Figure 1:
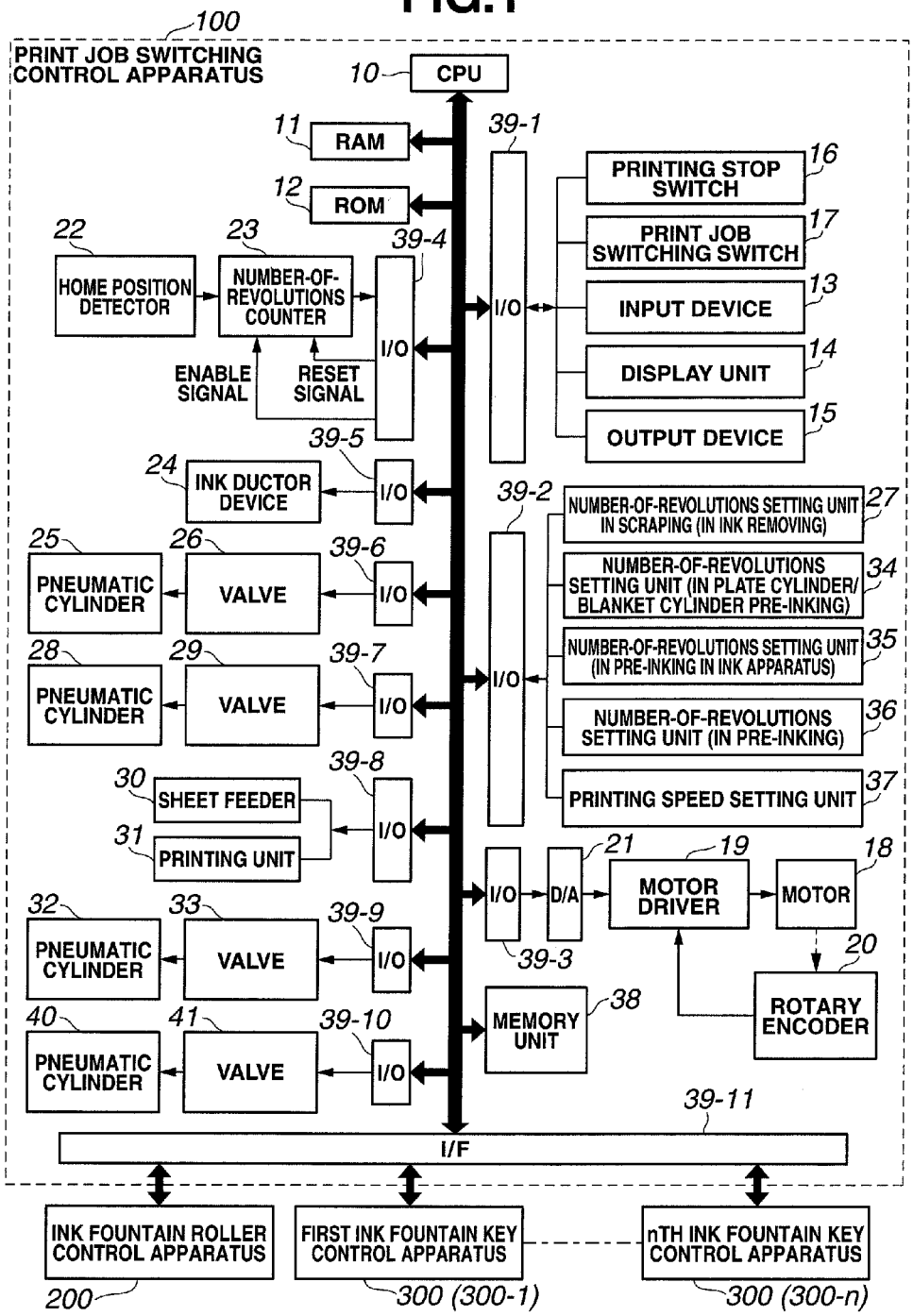
FIG. 1 is a block diagram showing a print job switching control apparatus which controls an ink supply apparatus in a printing unit according to an embodiment of the present invention.

A preferred embodiment of the present invention will be described in detail below with reference to the accompanying drawings.

A print job switching control apparatus 100 includes a CPU 10, a RAM 11, a ROM 12, an input device 13, a display unit 14, an output device (e.g., printer) 15, a printing stop switch 16, a print job switching start switch 17, a printing press drive motor 18, a drive motor driver 19, a drive motor rotary encoder 20, a D/A converter 21, a printing press home position detector 22, a counter 23 for counting the number of revolutions of a printing press, and an ink ductor device 24.

The print job switching control apparatus 100 includes a roller group division/coupling pneumatic cylinder 25, a roller group division/coupling pneumatic cylinder valve 26, a form dampening roller throw-on/off pneumatic cylinder 28, a form dampening roller throw-on/off pneumatic cylinder valve 29, a sheet feeder 30, a printing unit 31, an ink form roller throw-on/off pneumatic cylinder 32, an ink form roller throw-on/off pneumatic cylinder valve 33, an ink scraping blade throw-on/off pneumatic cylinder 40, an ink scraping blade throw-on/off pneumatic cylinder valve 41, a number-of-revolutions setting unit 27 in ink scraping, a number-of-revolutions setting unit 34 in plate cylinder/blanket cylinder pre-inking, a number-of-revolutions setting unit 35 in pre-inking in the ink apparatus, a number-of-revolutions setting unit 36 in pre-inking, a printing speed setting unit 37, a memory 38, and input/output interfaces (I/O I/Fs) 39-1 to 39-11.

Figure 2:
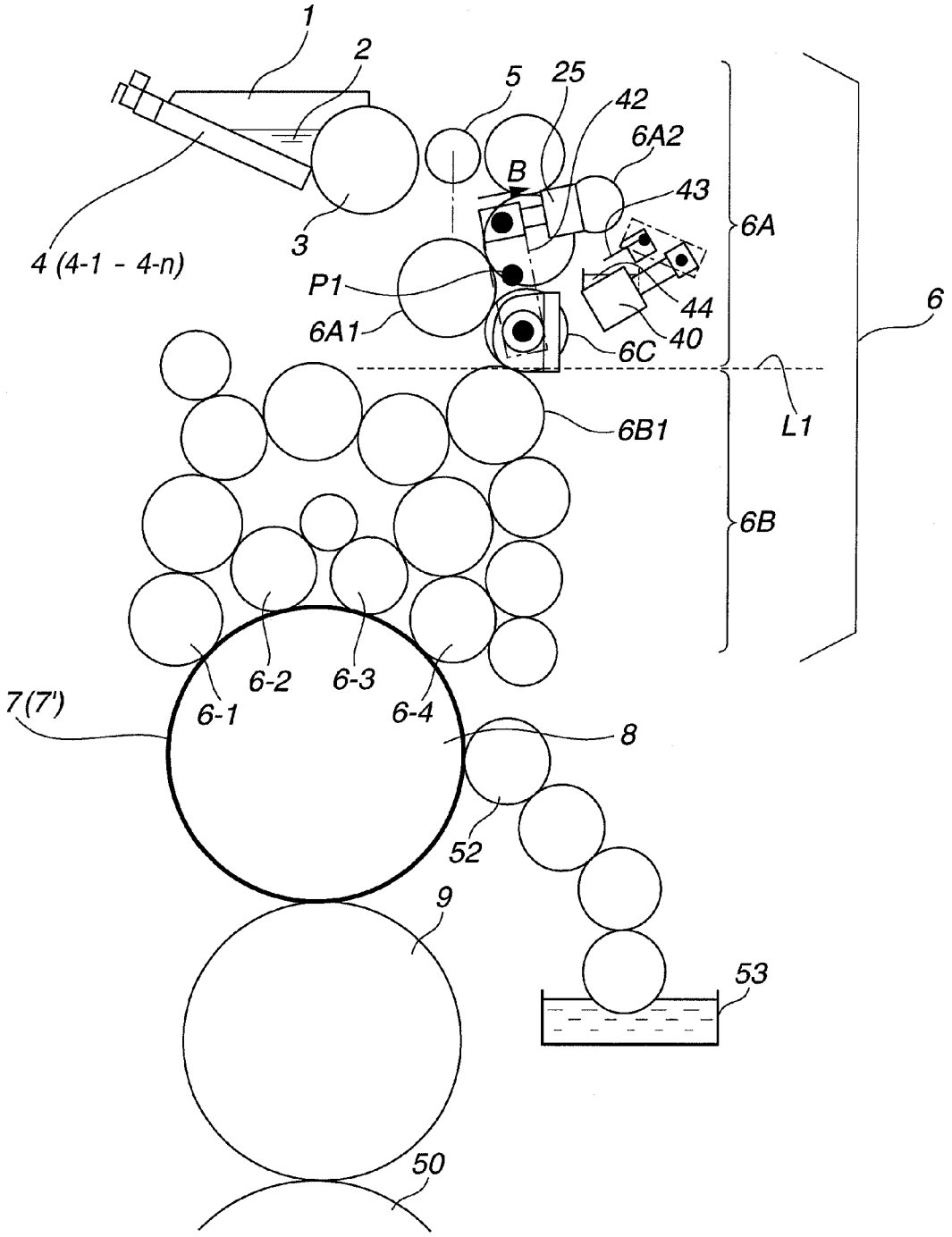
FIG. 2 is a view showing a state in which an ink roller group is coupled in the ink supply apparatus in the printing unit to be controlled by the print job switching control apparatus shown in FIG. 1.
Figure 15:
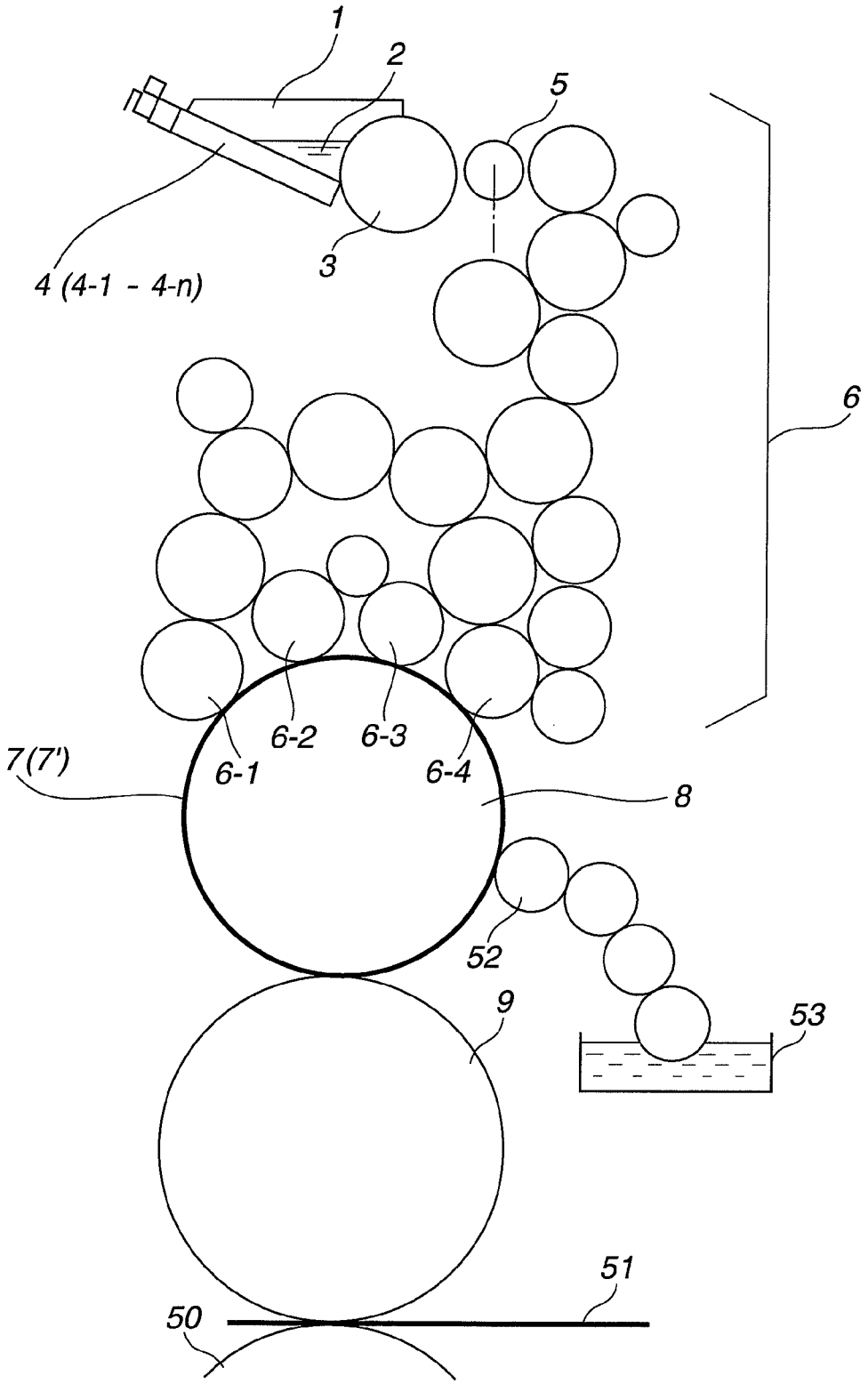
FIG. 15 is a view showing the main part of an ink supply apparatus in a printing unit of each color in a printing press.
Figure 16A:
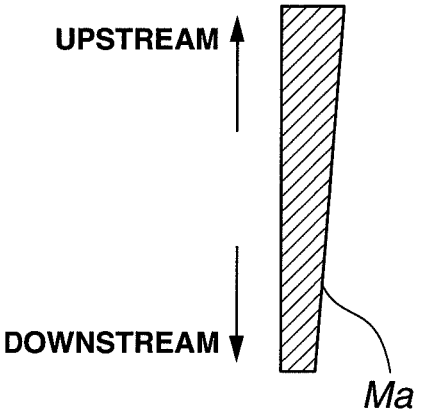
FIGS. 16A and 16B are views showing ink film thickness distributions Ma and Mb formed on the ink roller group of the ink supply apparatus, respectively.
Figure 16B:
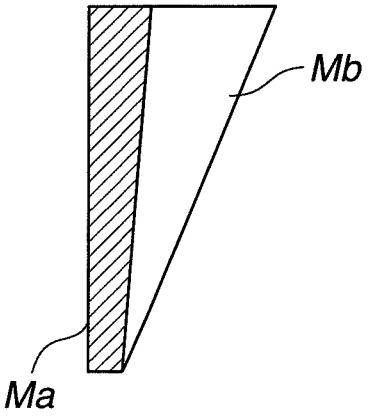

FIG. 2 shows the main part of an ink supply apparatus in each printing unit to be controlled by the print job switching control apparatus 100. In FIG. 2, the same reference numerals as those in FIG. 15 denote the same or similar parts as those shown in FIG. 15, and a description thereof will not be repeated. In the ink supply apparatus, an ink roller group 6 can be divided into an upstream roller subgroup 6A and downstream roller subgroup 6B at the boundary of a dotted line L1 shown in FIG. 2.

More specifically, a roller 6C positioned between the upstream roller subgroup 6A and the downstream roller subgroup 6B is axially supported by one end of a swing arm 42 which swings about a fulcrum P1 serving as the pivot center. The pneumatic cylinder 25 is coupled to the other end of the swing arm 42. Note that the swing arm 42 is indicated by a chain line in order to individualize it.

In this structure, when the pneumatic cylinder 25 extends (see FIG. 3), the swing arm 42 swings in a direction indicated by an arrow A about the fulcrum P1 serving as the pivot center. As the swing arm 42 swings, the outer surface of the roller 6C moves apart from that of a roller 6A1 positioned at the lowermost end of the ink flow path of the upstream roller subgroup 6A. At almost the same time, the outer surface of the roller 6C moves apart from that of a roller 6B1 positioned at the uppermost end of the ink flow path of the downstream roller subgroup 6B. As a result, the ink roller group 6 is divided into the upstream roller subgroup 6A and downstream roller subgroup 6B.

When the pneumatic cylinder 25 contracts from this state, the swing arm 42 swings in a direction indicated by an arrow B about the fulcrum P1 serving as the pivot center. As the swing arm 42 swings, the outer surface of the roller 6C comes into contact with that of the roller 6A1 positioned at the lowermost end of the ink flow path of the upstream roller subgroup 6A. At almost the same time, the outer surface of the roller 6C comes into contact with that of the roller 6B1 at the uppermost end of the ink flow path of the downstream roller subgroup 6B (see FIG. 2). Accordingly, the upstream roller subgroup 6A and downstream roller subgroup 6B are coupled and returned to the single ink roller group 6.

An ink scraping blade 43 which comes into contact with the outer surface of a roller 6A2 of the upstream roller subgroup 6A to scrape ink in the upstream roller subgroup 6A, and an ink receiver 44 which recovers ink scraped by the ink scraping blade 43 are arranged near the ink roller group 6. A pneumatic cylinder 40 is arranged in correspondence with the blade 43. When scraping ink, the pneumatic cylinder 40 contracts to bring the blade 43 into contact with the outer surface of the roller 6A2 (see FIG. 4). When the pneumatic cylinder 40 extends, the blade 43 moves apart from the outer surface of the roller 6A2.

In the print job switching control apparatus 100, the CPU 10 obtains various kinds of information input via the interfaces 39-1 to 39-11. While accessing the RAM 11 and memory unit 38, the CPU 10 operates in accordance with a program stored in the ROM 12.

The rotary encoder 20 generates a rotation pulse at every predetermined rotation angle of the printing press drive motor 18, and outputs it to the drive motor driver 19. The printing press home position detector 22 detects a home position in every rotation of the printing press, generates a home position detection signal, and outputs it to the counter 23.

The ink ductor device 24 is arranged for the ink ductor roller 5. When the ink ductor device 24 is turned on, the ink feed operation of the ink ductor roller 5 starts. When the ink ductor device 24 is turned off, the ink feed operation of the ink ductor roller 5 stops.

The pneumatic cylinder 28 is arranged for a form dampening roller 52. When the pneumatic cylinder 28 extends, the form dampening roller 52 is thrown on (comes into contact with a printing plate 7 (7')). When the pneumatic cylinder 28 contracts, the form dampening roller 52 is thrown off (moves apart from the printing plate 7 (7')).

The pneumatic cylinder 32 is arranged for ink form rollers 6-1 to 6-4. When the pneumatic cylinder 32 extends, the ink form rollers 6-1 to 6-4 are thrown on (come into contact with the printing plate 7 (7')). When the pneumatic cylinder 32 contracts, the ink form rollers 6-1 to 6-4 are thrown off (move apart from the printing plate 7 (7')).

Figure 5:
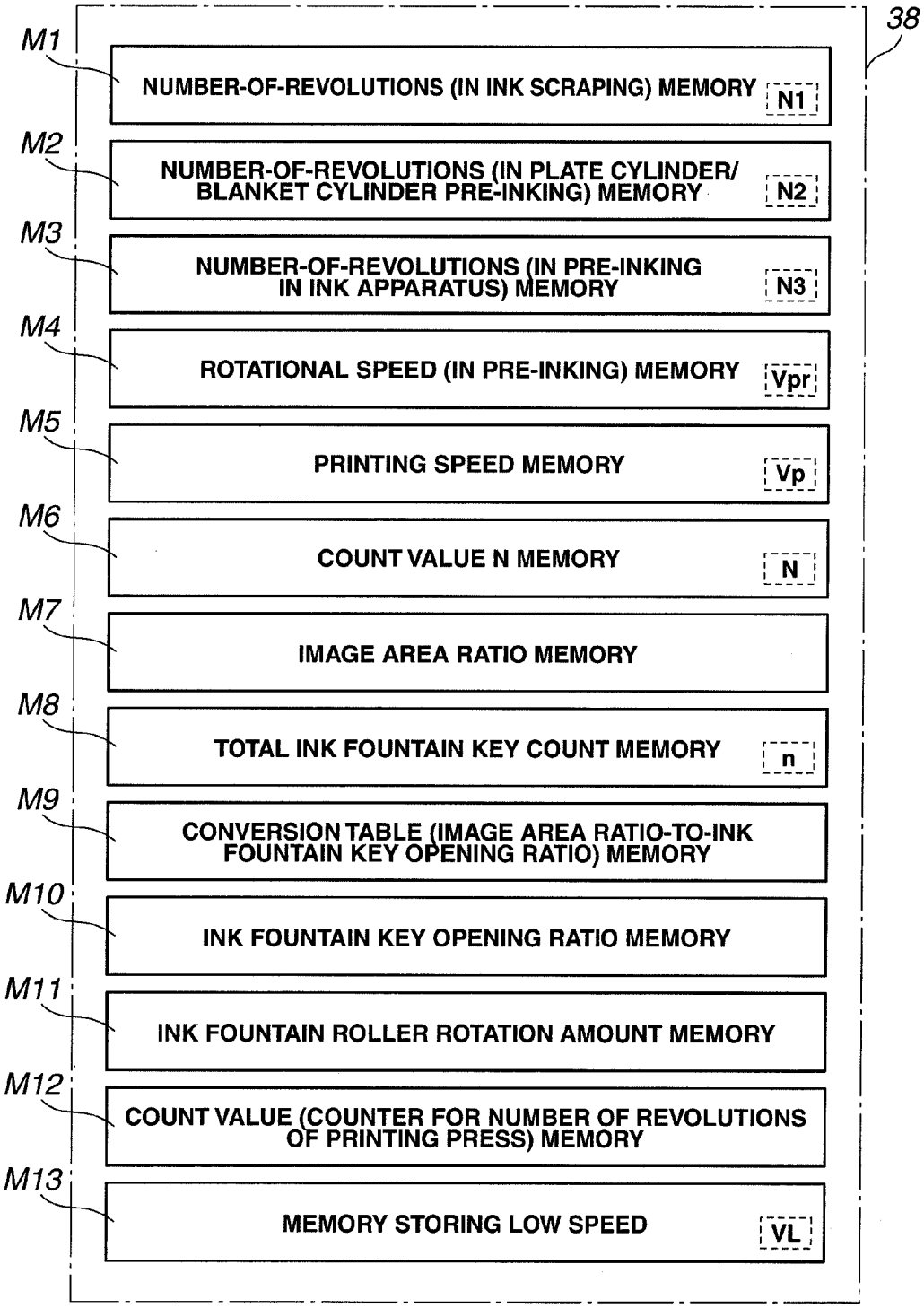
FIG. 5 is a view showing details of a memory unit shown in FIG. 1.

FIG. 5 shows the contents of the memory unit 38. The memory unit 38 includes memories M1 to M13. The memory M1 stores the number N1 of revolutions of the printing press in ink scraping. The memory M2 stores the number N2 of revolutions of the printing press in plate cylinder/blanket cylinder pre-inking. The memory M3 stores the number N3 of revolutions of the printing press in pre-inking in the ink apparatus. The memory M4 stores a rotational speed Vpr of the printing press in pre-inking. The memory M5 stores a printing speed Vp. The memory M6 stores a count value N. The memory M7 stores the image area ratio of a range corresponding to each ink fountain key. The memory M8 stores a total ink fountain key count n. The memory M9 stores an image area ratio-to-ink fountain key opening ratio conversion table representing the relationship between the image area ratio and the opening ratio of the ink fountain key. The memory M10 stores the opening ratio of each ink fountain key. The memory M11 stores the rotation amount of the ink fountain roller. The memory M12 stores the count value of the counter for counting the number of revolutions of the printing press. The memory M13 stores a low speed VL of the printing press.

In FIG. 1, an ink fountain roller control apparatus 200 drives the ink fountain roller 3 in the ink supply apparatus. Ink fountain key control apparatuses 300-1 to **300-*n* control the opening ratios of the ink fountain keys 4-1 to 4-*n* in the ink supply apparatus. The ink fountain roller control apparatus 200 and ink fountain key control apparatuses 300-1 to 300-*n*** are arranged for ink supply apparatuses of respective colors. However, the embodiment will explain one ink supply apparatus for descriptive convenience. That is, the operation of one of the ink supply apparatuses will be explained as a representative.

[Schematic Operation of Print Job Switching Control Apparatus]

Before a description of the detailed operation of the print job switching control apparatus 100, a schematic operation will be explained to facilitate understanding.

Figures 6A, 6B, 6C, 6D, 6E, 6F, 6G, 6H, 6I, 6J:
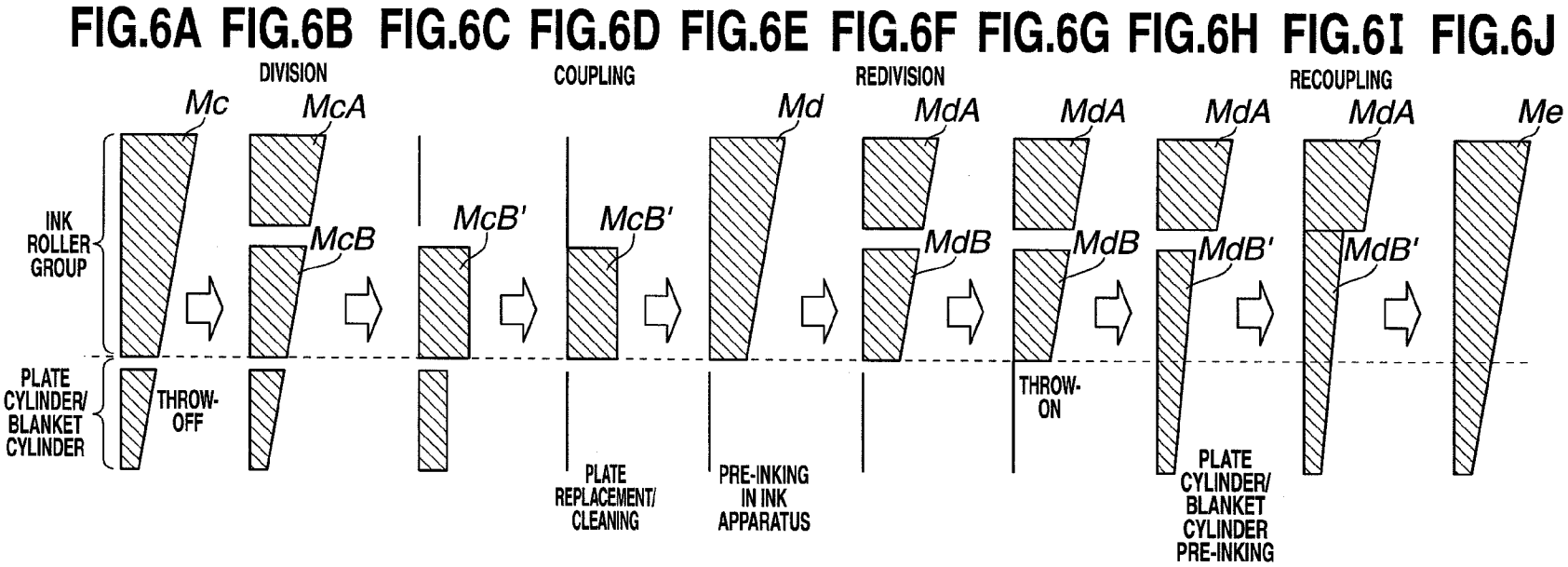
FIGS. 6A to 6J are views showing processes of forming the ink film thickness distribution of the next print job in the ink roller group and on a plate cylinder and blanket cylinder when switching a print job.

(1) Sheet feed is stopped, and printing using the printing plate 7 is stopped (a preceding print job is ended). After printing stops, impression throw-off is performed to separate the blanket cylinder 9 from the plate cylinder 8 and impression cylinder 50. Also, the ink form rollers 6-1 to 6-4 and the form dampening roller 52 are thrown off and separated from the plate cylinder 8 (see FIG. 3). In this case, an ink film thickness distribution Mc corresponding to an image on the printing plate 7 remains in the ink roller group 6, as shown in FIG. 6A. That is, the ink film thickness distribution Mc of the preceding print job remains.

(2) The ink feed operation of the ink ductor roller 5 is stopped while the printing press stops. The ink roller group 6 is divided into the upstream roller subgroup 6A and downstream roller subgroup 6B. As shown in FIG. 6B, the ink film thickness distribution Mc of the ink roller group 6 is divided into an ink film thickness distribution McA of the upstream roller subgroup 6A and an ink film thickness distribution McB of the downstream roller subgroup 6B.

(3) The rotational speed of the printing press is increased to the printing speed, and the blade 43 is thrown on the roller 6A2 in the upstream roller subgroup 6A. In this state, the printing press rotates by a predetermined number of revolutions (number N1 of revolutions in ink scraping), and ink in the upstream roller subgroup 6A is scraped (see FIG. 4). Hence, the ink film thickness distribution McA of the upstream roller subgroup 6A becomes almost 0, as shown in FIG. 6C. At this time, the ink film thickness distribution of the downstream roller subgroup 6B is leveled by the number N1 of revolutions in ink scraping, obtaining a flat ink film thickness distribution McB'.

(4) The printing press is stopped, the printing plate 7 mounted on the plate cylinder 8 is replaced with the printing plate 7' to be used for printing of the next job. In addition, the blanket cylinder 9 is cleaned (FIG. 6D).

(5) The opening ratios of the ink fountain keys 4-1 to **4-*n* are set to values corresponding to an image on the printing plate 7' to be used for printing of the next job. That is, the opening ratios of the ink fountain keys 4-1 to 4-*n* are set to values corresponding to the image of the next print job. The printing press is speeded up to the rotational speed Vpr in pre-inking. In this state, the ink feed operation of the ink ductor roller 5 is performed by the number N3 of revolutions in pre-inking in the ink apparatus. An ink film thickness distribution Md in printing of the next job is formed in the ink roller group 6 (FIG. 6**E).

(6) The ink feed operation of the ink ductor roller 5 is stopped, and the ink roller group 6 is divided into the upstream roller subgroup 6A and downstream roller subgroup 6B. As shown in FIG. 6F, the ink film thickness distribution Md of the ink roller group 6 is divided into an ink film thickness distribution MdA of the upstream roller subgroup 6A and an ink film thickness distribution MdB of the downstream roller subgroup 6B.

(7) The ink form rollers 6-1 to 6-4 and the form dampening roller 52 are thrown on, and only the plate cylinder 8 and blanket cylinder 9 are thrown on. That is, the ink form rollers 6-1 to 6-4 and the form dampening roller 52 contact the plate surface of the printing plate 7', and the blanket cylinder 9 is thrown only on the plate cylinder 8 (the ink feed operation remains stopped). Hence, the downstream roller subgroup 6B, form dampening roller 52, plate cylinder 8, and blanket cylinder 9 are thrown on (FIG. 6G).

(8) In this state, the printing press rotates by the number N2 of revolutions in plate cylinder/blanket cylinder pre-inking, and ink in the downstream roller subgroup 6B is supplied to the printing plate 7' mounted on the plate cylinder 8, and the blanket cylinder 9 (FIG. 6H). In this case, only ink of the relatively thin ink film thickness distribution MdB in the downstream roller subgroup 6B is supplied to the printing plate 7' and blanket cylinder 9, preventing the ink film thickness distribution on the printing plate 7' and blanket cylinder 9 from becoming excessively thick.

Figures 7A, 7B, 7C, 7D, 7E, 7F, 7G, 7H:
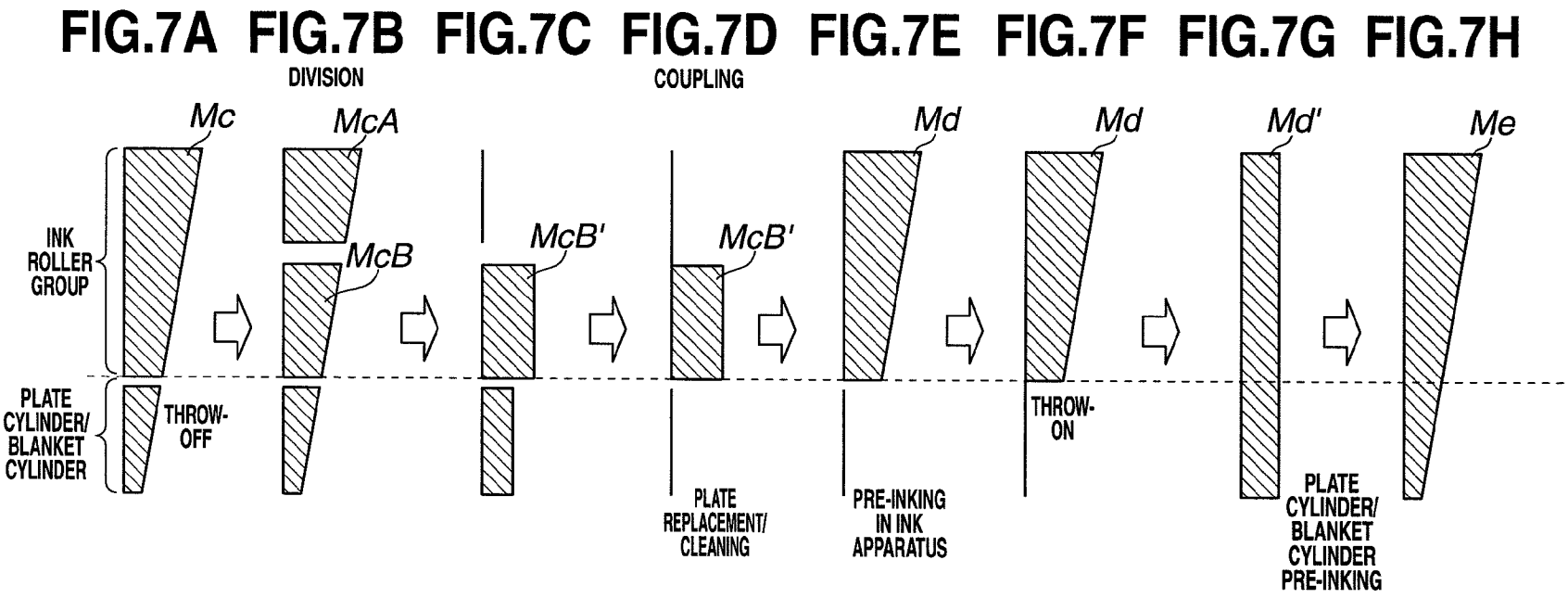
FIGS. 7A to 7H are views showing, in correspondence with FIGS. 6A to 6J, ink film thickness distribution formation processes when the ink film thickness distribution of the next print job is formed without dividing the ink roller group after pre-inking in an ink apparatus.

As shown in FIGS. 7A to 7H, it is possible to, after the process in FIG. 7E corresponding to FIG. 6E, throw on the ink form rollers 6-1 to 6-4, form dampening roller 52, plate cylinder 8, and blanket cylinder 9 without dividing the ink roller group 6 (FIG. 7F), rotate the printing press by a predetermined number of times, and supply ink to even the plate cylinder 8 and blanket cylinder 9. In this case, however, all ink in the ink supply apparatus is leveled by the ink roller group 6, plate cylinder 8, and blanket cylinder 9. Thus, an excessively large amount of ink is supplied to the plate cylinder 8 and blanket cylinder 9, and the ink film thickness distribution on the plate cylinder 8 and blanket cylinder 9 becomes excessively thick (FIG. 7G).

To the contrary, after the process in FIG. 6E, the ink roller group 6 is divided into the upstream roller subgroup 6A and downstream roller subgroup 6B (FIG. 6F). In this case, only ink of the relatively thin ink film thickness distribution MdB in the downstream roller subgroup 6B is supplied to the printing plate 7' and blanket cylinder 9 (FIGS. 6G and 6H), preventing the ink film thickness distribution on the printing plate 7' and blanket cylinder 9 from becoming excessively thick.

(9) Thereafter, the upstream roller subgroup 6A and downstream roller subgroup 6B are coupled and returned to the single ink roller group 6 (FIG. 6I). The ink feed operation of the ink ductor roller 5 is performed. The blanket cylinder 9 is thrown even on the impression cylinder 50, that is, an impression throw-on state in which the plate cylinder 8, blanket cylinder 9, and impression cylinder 50 contact each other is set (see FIG. 2). Then, printing of the next job starts using the printing plate 7' mounted on the plate cylinder 8.

In this case, an ink film thickness distribution (ink film thickness distribution in final printing) in printing of the next job is formed during printing. At this time, an ink film thickness distribution MdB' in the downstream roller subgroup 6B and on the plate cylinder 8 and blanket cylinder 9 has become thin. Thus, ink flows fast from the upstream side to the downstream side, quickly forming an ink film thickness distribution Me (FIG. 6J) during final printing in the ink roller group 6 and on the plate cylinder 8 and blanket cylinder 9.

According to the method shown in FIGS. 7A to 7H, the ink film thickness distribution on the plate cylinder 8 and blanket cylinder 9 becomes excessively thick (FIG. 7G). Time is therefore taken to form an ink film thickness distribution Me (FIG. 7H) during final printing, wasting many sheets. In contrast, the embodiment prevents the ink film thickness distribution formed on the plate cylinder 8 and blanket cylinder 9 from becoming excessively thick. Ink flows fast from the upstream side to the downstream side, quickly forming an ink film thickness distribution during final printing in the ink roller group 6 and on the plate cylinder 8 and blanket cylinder 9. After the printing plate 7' is replaced and printing of the next job starts, a normal printing product can be obtained within a short time.

Figures 8A, 8B, 8C, 8D, 8E, 8F, 8G, 8H, 8I, 8J:
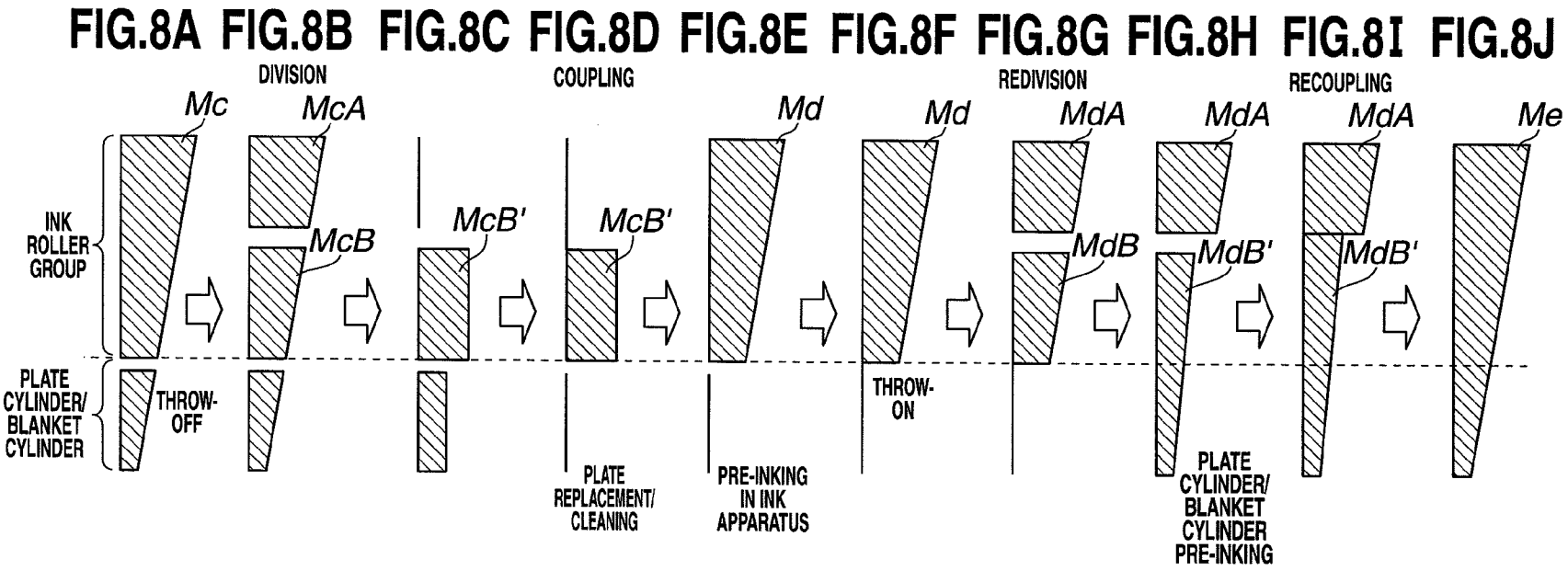
FIGS. 8A to 8J are views showing, in correspondence with FIGS. 6A to 6J, ink film thickness distribution formation processes when a downstream roller subgroup, the plate cylinder, and the blanket cylinder are thrown on before dividing the ink roller group.

In the schematic operation described with reference to FIGS. 6A to 6J, the ink roller group 6 is divided into the upstream roller subgroup 6A and downstream roller subgroup 6B (FIG. 6F), and then the downstream roller subgroup 6B is thrown on the plate cylinder 8 (FIG. 6G). However, as shown in FIGS. 8A to 8J, it is also possible to throw the downstream roller subgroup 6B on the plate cylinder 8 before dividing the ink roller group 6 into the upstream roller subgroup 6A and downstream roller subgroup 6B (FIG. 8F), and then divide the ink roller group 6 into the upstream roller subgroup 6A and downstream roller subgroup 6B (FIG. 8G).

[Detailed Operation of Print Job Switching Control Apparatus]

When switching a print job, the operator turns on the printing stop switch 16. Then, the CPU 10 confirms that the printing stop switch 16 has been turned on (FIG. 9A: YES in step S101), and outputs a sheet feed stop signal to the sheet feeder 30 to stop sheet feed to the printing press (step S102). Subsequently, the CPU 10 outputs an impression throw-off command, ink form roller throw-off command, and form dampening roller throw-off command sequentially (steps S103, S104, and S105).

By the impression throw-off command, the blanket cylinder 9 is thrown off the plate cylinder 8 and impression cylinder 50. By the ink form roller throw-off command, the ink form rollers 6-1 to 6-4 are thrown off and separated from the printing plate 7. By the form dampening roller throw-off command, the form dampening roller 52 is thrown off and separated from the printing plate 7. The CPU 10 outputs a stop signal to the motor driver 19 (step S106) to stop the drive motor 18. As a result, the printing press stops, and the ink film thickness distribution changes to a state shown in FIG. 6A.

[Data Input]

Figure 9A:
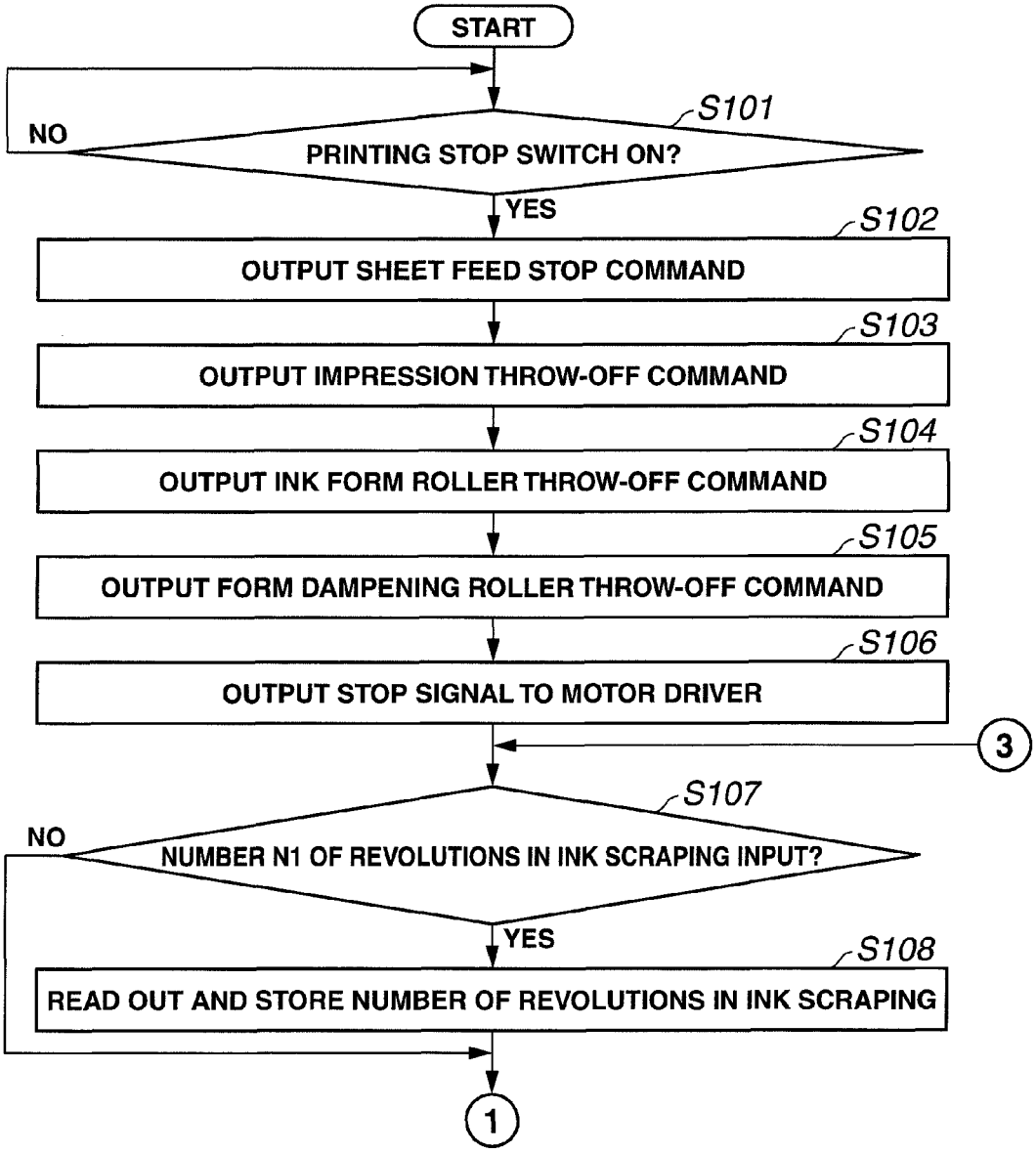
FIGS. 9A to 9J are flowcharts for explaining the detailed operation of the print job switching control apparatus shown in FIG. 1.
Figure 9B:
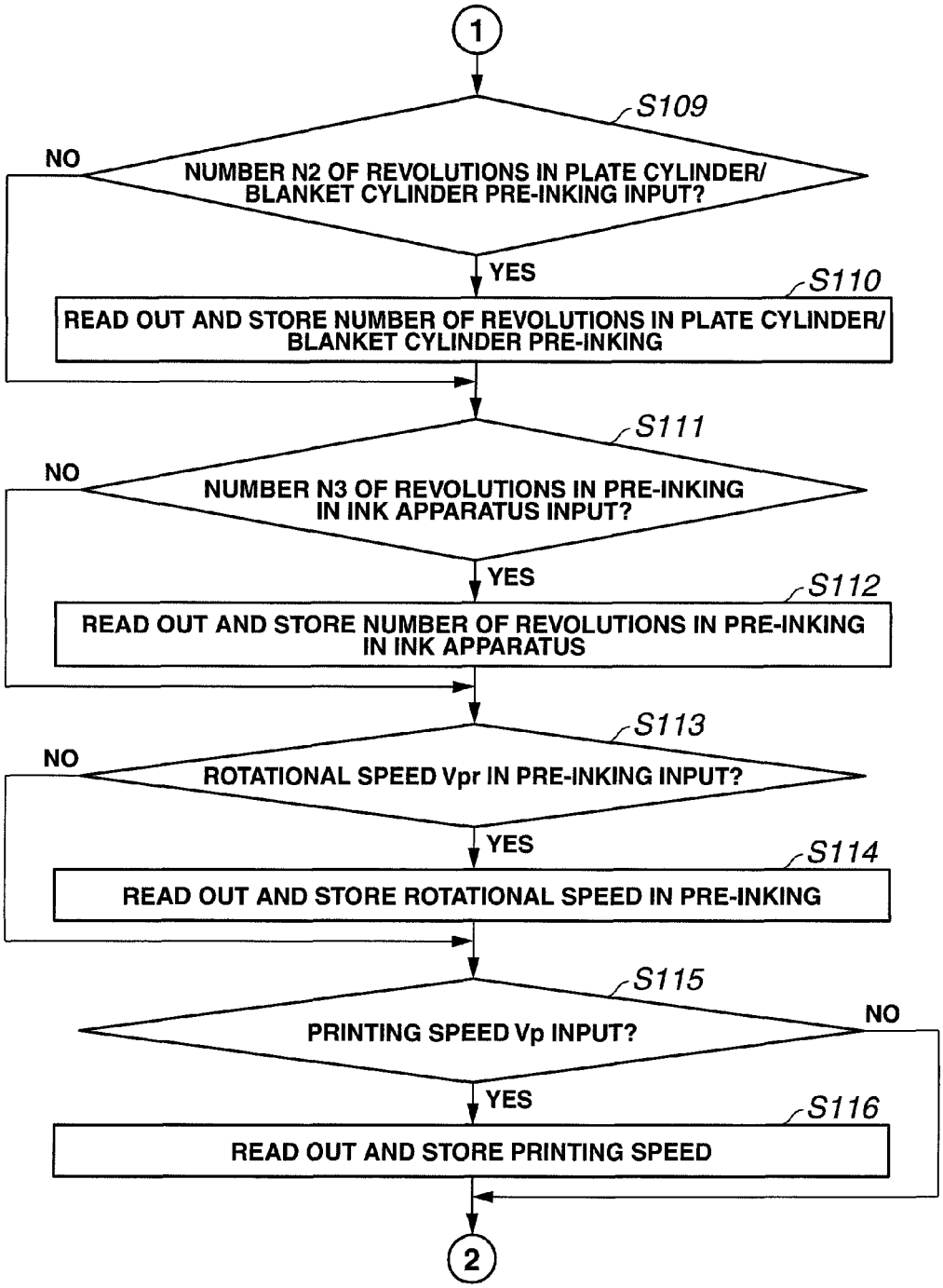

The operator inputs the number N1 of revolutions of the printing press in ink scraping, the number N2 of revolutions of the printing press in plate cylinder/blanket cylinder pre-inking, the number N3 of revolutions of the printing press in pre-inking in the ink apparatus, the rotational speed Vpr of the printing press in pre-inking, and the printing speed Vp (FIG. 9A: step S107, FIG. 9B: steps S109, S111, S113, and S115).

In this case, the number N1 of revolutions in ink scraping is input from the number-of-revolutions setting unit 27. The number N2 of revolutions in plate cylinder/blanket cylinder pre-inking is input from the number-of-revolutions setting unit 34. The number N3 of revolutions in pre-inking in the ink apparatus is input from the number-of-revolutions setting unit 35. The rotational speed Vpr is input from the number-of-revolutions setting unit 36. The printing speed Vp is input from the printing speed setting unit 37.

The CPU 10 stores, in the memory M1, the number N1 of revolutions in ink scraping that has been input from the number-of-revolutions setting unit 27 (step S108). The CPU 10 stores, in the memory M2, the number N2 of revolutions in plate cylinder/blanket cylinder pre-inking that has been input from the number-of-revolutions setting unit 34 (step S110). The CPU 10 stores, in the memory M3, the number N3 of revolutions in pre-inking in the ink apparatus that has been input from the number-of-revolutions setting unit 35 (step S112). The CPU 10 stores, in the memory M4, the rotational speed Vpr input from the number-of-revolutions setting unit 36 (step S114). The CPU 10 stores, in the memory M5, the printing speed Vp input from the printing speed setting unit 37 (step S116).

[Input of Image Area Ratio of Printing Plate for Next Print Job]

The CPU 10 stores, in the memory M7, the image area ratios of ranges corresponding to the ink fountain keys 4-1 to **4-*n* on the printing plate 7 that have been input from the input device 13. In the embodiment, the image area ratios of the ranges corresponding to the ink fountain keys 4-1 to 4-*n* on the printing plate 7 are measured using an "image area ratio measurement apparatus" as disclosed in Japanese Patent Laid-Open No. 58-201008 (literature 4) or Japanese Patent Laid-Open No. 58-201010 (literature 5) by the present applicant. Image area ratios measured using the "image area ratio measurement apparatus" are written in a portable memory. The portable memory in which the image area ratios are written is set in the input device 13, inputting the image area ratios of the ranges corresponding to the ink fountain keys 4-1 to 4-*n* on the printing plate 7. Note that the CPU 10 and the "image area ratio measurement apparatus" may be connected online to directly receive, from the "image area ratio measurement apparatus", the image area ratios of the ranges corresponding to the ink fountain keys 4-1 to 4-*n* on the printing plate 7**.

Figure 9C:
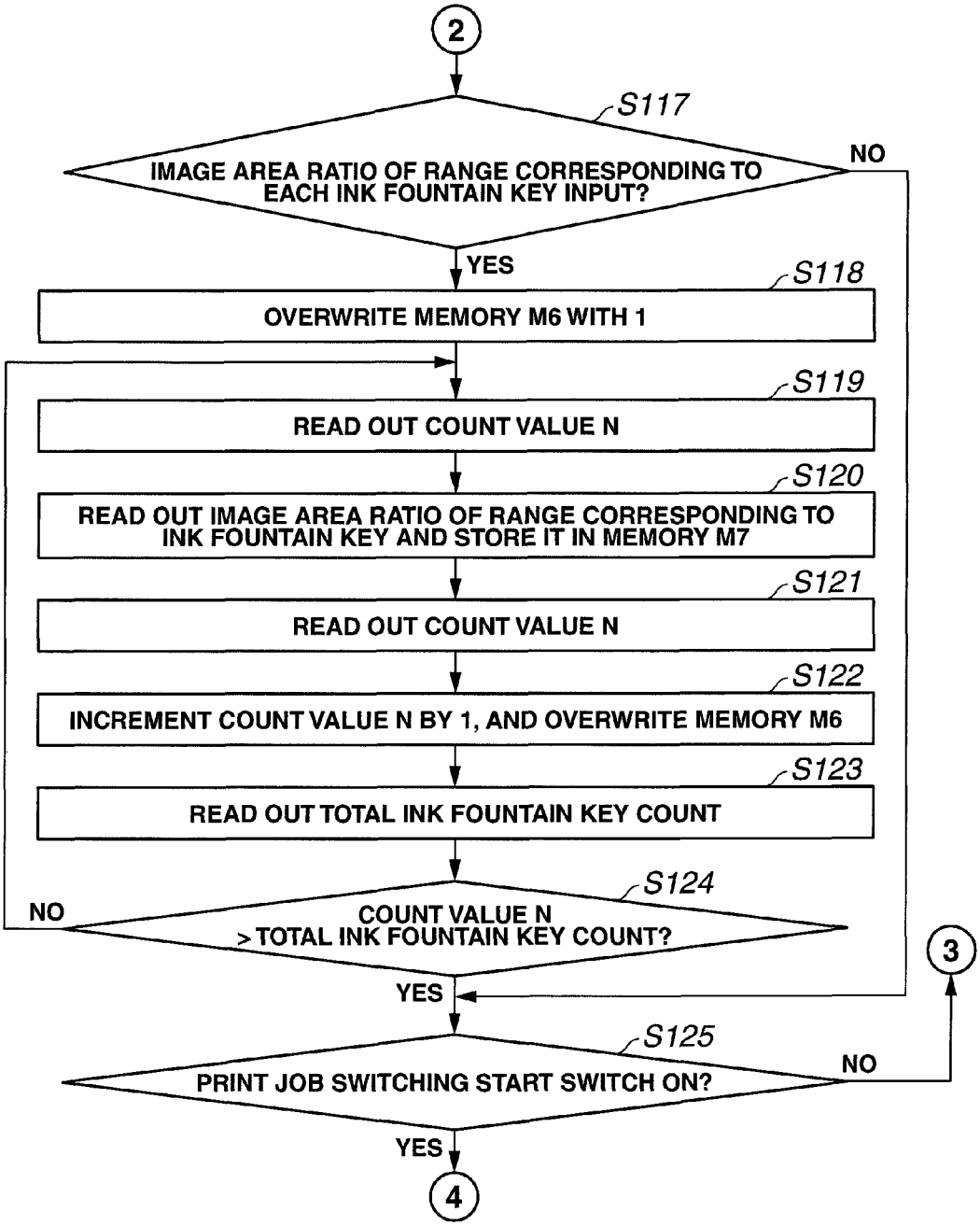

If the portable memory is set in the input device 13, that is, the image area ratios of the ranges corresponding to the ink fountain keys 4-1 to **4-*n* are input (FIG. 9C: YES in step S117), the CPU 10 overwrites the count value N in the memory M6 with N=1 (step S118), and reads out the count value N from the memory M6 (step S119). The CPU 10 reads out the image area ratio of a range corresponding to the Nth ink fountain key from the portable memory, and stores it at an address position for the Nth ink fountain key in the memory M7 (step S120**).

The CPU 10 reads out the count value N from the memory M6 (step S121), increments the count value N by one, and overwrites the memory M6 with it (step S122). The CPU 10 reads out the total ink fountain key count n from the memory M8 (step S123). The CPU 10 repeats the processing operations in steps S119 to S124 until the count value N exceeds the total ink fountain key count n (YES in step S124). As a result, the image area ratios of the respective regions corresponding to the ink fountain keys 4-1 to **4-*n* on the printing plate 7 are read out from the portable memory, and stored in the memory M7**.

[Setting of Opening Ratio of Ink Fountain Key Corresponding to Image on Printing Plate for Next Print Job]

Figure 9D:
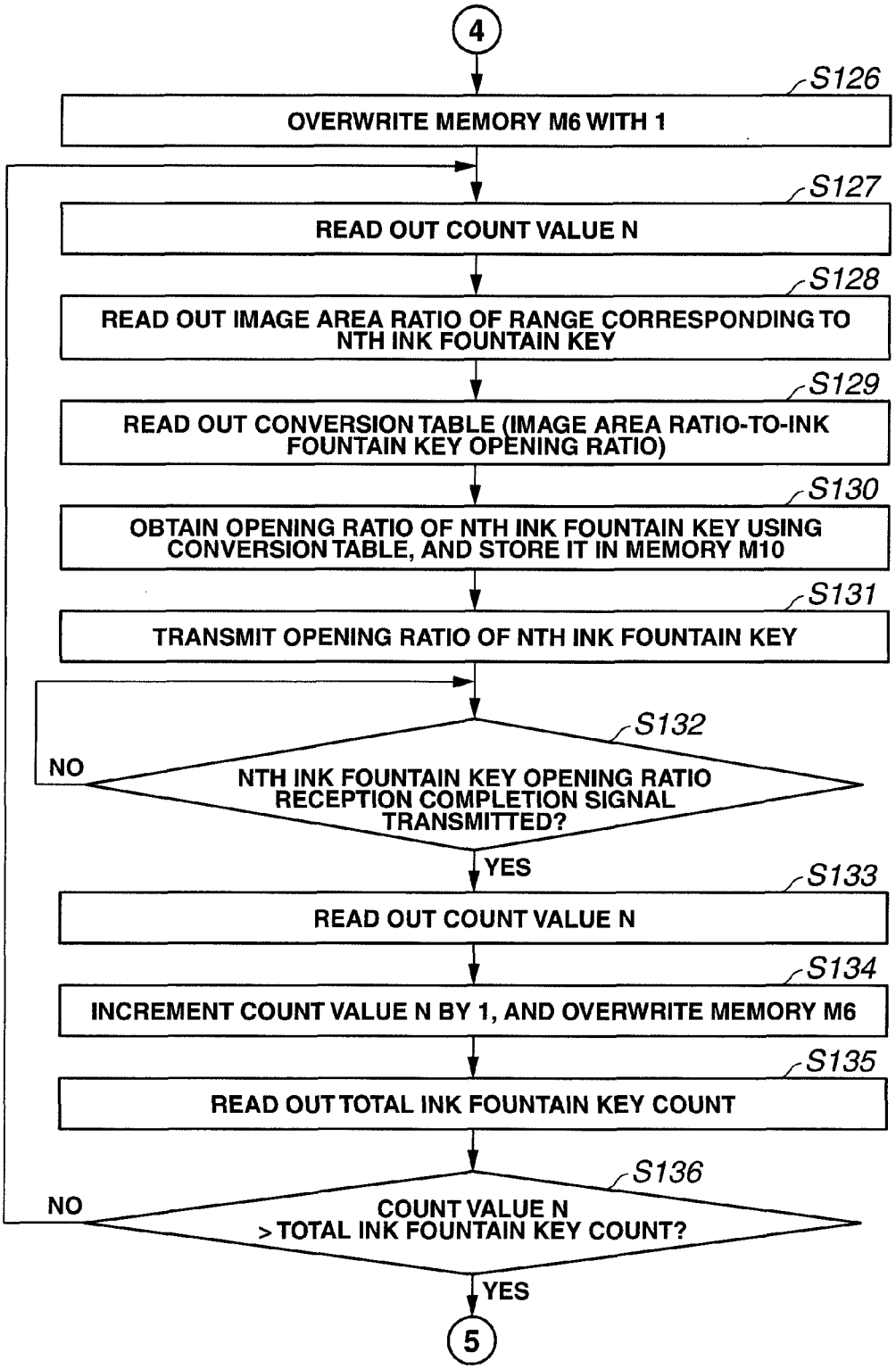

The operator turns on the print job switching start switch 17. If the print job switching start switch 17 has been turned on (YES in step S125), the CPU 10 overwrites the count value N in the memory M6 with N=1 (FIG. 9D: step S126). The CPU 10 reads out the count value N from the memory M6 (step S127), and reads out the image area ratio of the range corresponding to the Nth ink fountain key from the address position for the Nth ink fountain key in the memory M7 (step S128).

The CPU 10 reads out the conversion table from the memory M9 (step S129). By using the conversion table, the CPU 10 obtains the opening ratio of the Nth ink fountain key from the image area ratio of the range corresponding to the Nth ink fountain key. The CPU 10 stores the obtained opening ratio of the Nth ink fountain key at an address position for the Nth ink fountain key in the memory M10 (step S130), and transmits it to the Nth ink fountain key control apparatus 300 (step S131).

The CPU 10 confirms that the Nth ink fountain key control apparatus 300 has transmitted an Nth ink fountain key opening ratio reception completion signal (YES in step S132). Then, the CPU 10 reads out the count value N from the memory M6 (step S133), increments the count value N by one, and overwrites the memory M6 with it (step S134). The CPU 10 reads out the total ink fountain key count n from the memory M8 (step S135). The CPU 10 repeats the processing operations in steps S127 to S136 until the count value N exceeds the total ink fountain key count n (YES in step S136).

Accordingly, the opening ratios of the ink fountain keys 4-1 to **4-*n* that correspond to the image area ratios of the ranges corresponding to the ink fountain keys 4-1 to 4-*n* on the printing plate 7' are obtained, stored in the memory M10, and transmitted to the ink fountain key control apparatuses 300-1 to 300-*n***.

[Confirmation of Completion of Setting Opening Ratio of Ink Fountain Key]

Figure 9E:
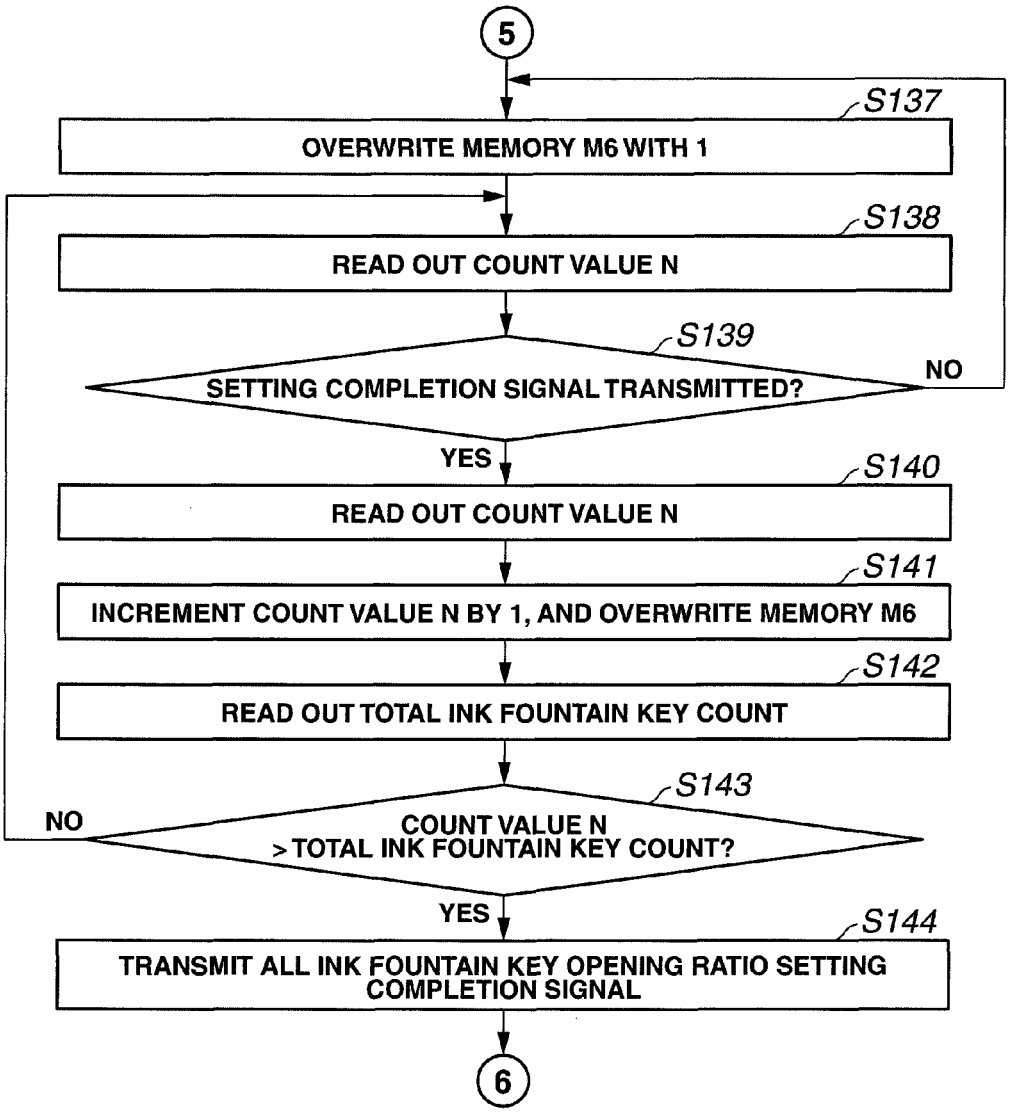

The CPU 10 overwrites the count value N in the memory M6 with N=1 (FIG. 9E: step S137), and reads out the count value N from the memory M6 (step S138). The CPU 10 confirms the presence/absence of an ink fountain key opening ratio setting completion signal from the Nth ink fountain key control apparatus 300 (step S139).

If the CPU 10 confirms that the Nth ink fountain key control apparatus 300 has transmitted the ink fountain key opening ratio setting completion signal (YES in step S139), the CPU 10 reads out the count value N from the memory M6 (step S140). The CPU 10 increments the count value N by one, and overwrites the memory M6 with it (step S141). The CPU 10 reads out the total ink fountain key count n from the memory M8 (step S142). The CPU 10 repeats the processing operations in steps S138 to S143 until the count value N exceeds the total ink fountain key count n (YES in step S143).

If the count value N exceeds the total ink fountain key count n (YES in step S143), the CPU 10 determines that the setting of the opening ratios of the ink fountain keys has been completed. The CPU 10 transmits an all ink fountain key opening ratio setting completion signal to all the ink fountain key control apparatuses 300 (300-1 to **300-*n*) (step S144**).

[Division of Ink Roller Group]

Figure 9F:
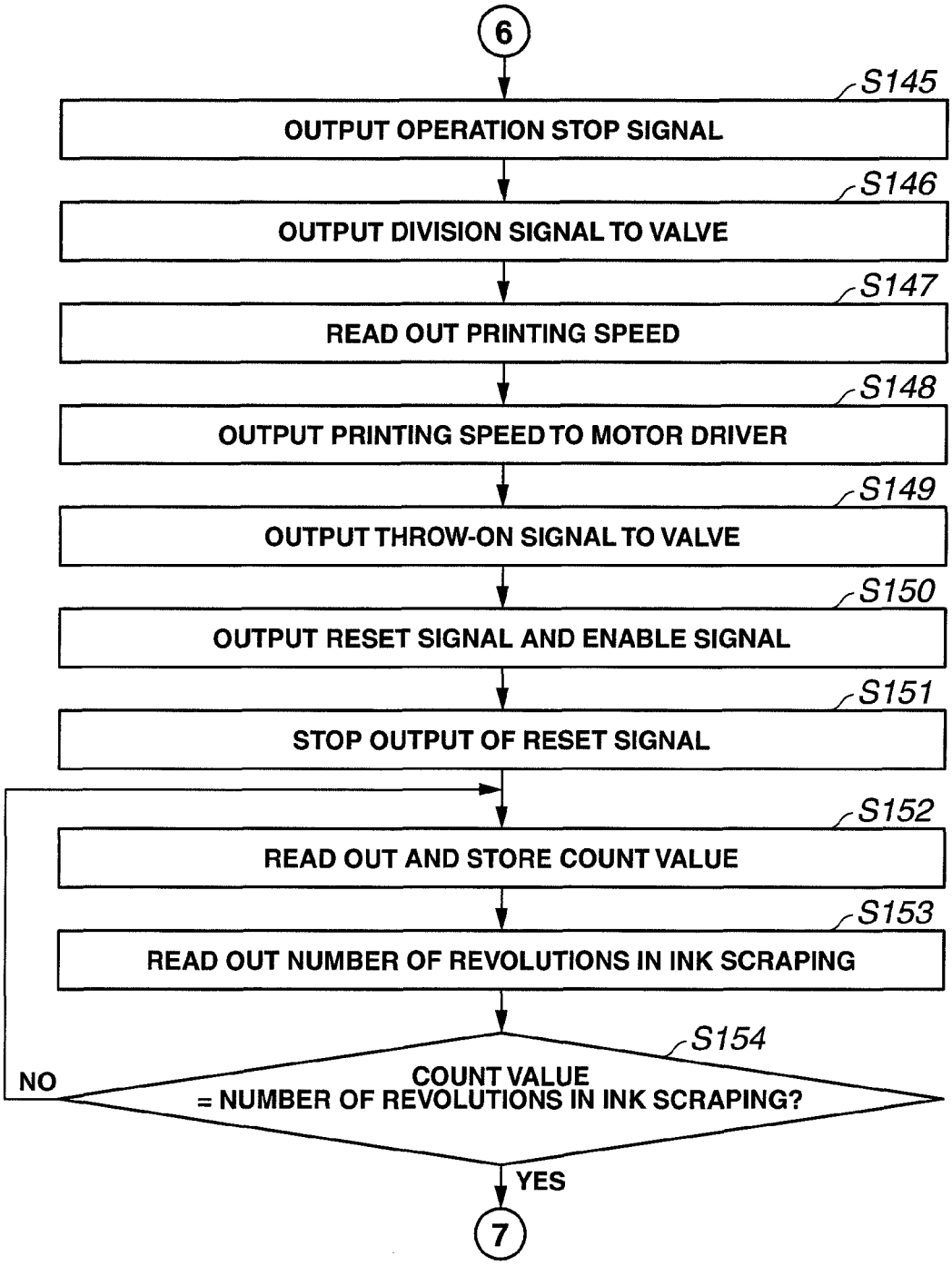

The CPU 10 outputs an operation stop signal to the ink ductor device 24 (FIG. 9F: step S145) to stop the ink feed operation of the ink ductor roller 5. Note that the throw-off operation of the ink form rollers 6-1 to 6-4 by the CPU 10 (step S104), the stop of the ink feed operation of the ink ductor roller 5 (step S145), the ink ductor device 24, and the pneumatic cylinder 32 constitute a step/means for disconnecting the ink roller group 6 from the ink supply path. Thereafter, the CPU 10 outputs a division signal to the valve 26 (step S146) to divide the ink roller group 6 into the upstream roller subgroup 6A and downstream roller subgroup 6B (see FIG. 3).

As shown in FIG. 6B, the ink film thickness distribution Mc of the ink roller group 6 is divided into the ink film thickness distribution McA of the upstream roller subgroup 6A and the ink film thickness distribution McB of the downstream roller subgroup 6B.

[Scraping of Ink in Upstream Roller Subgroup]

Figure 4:
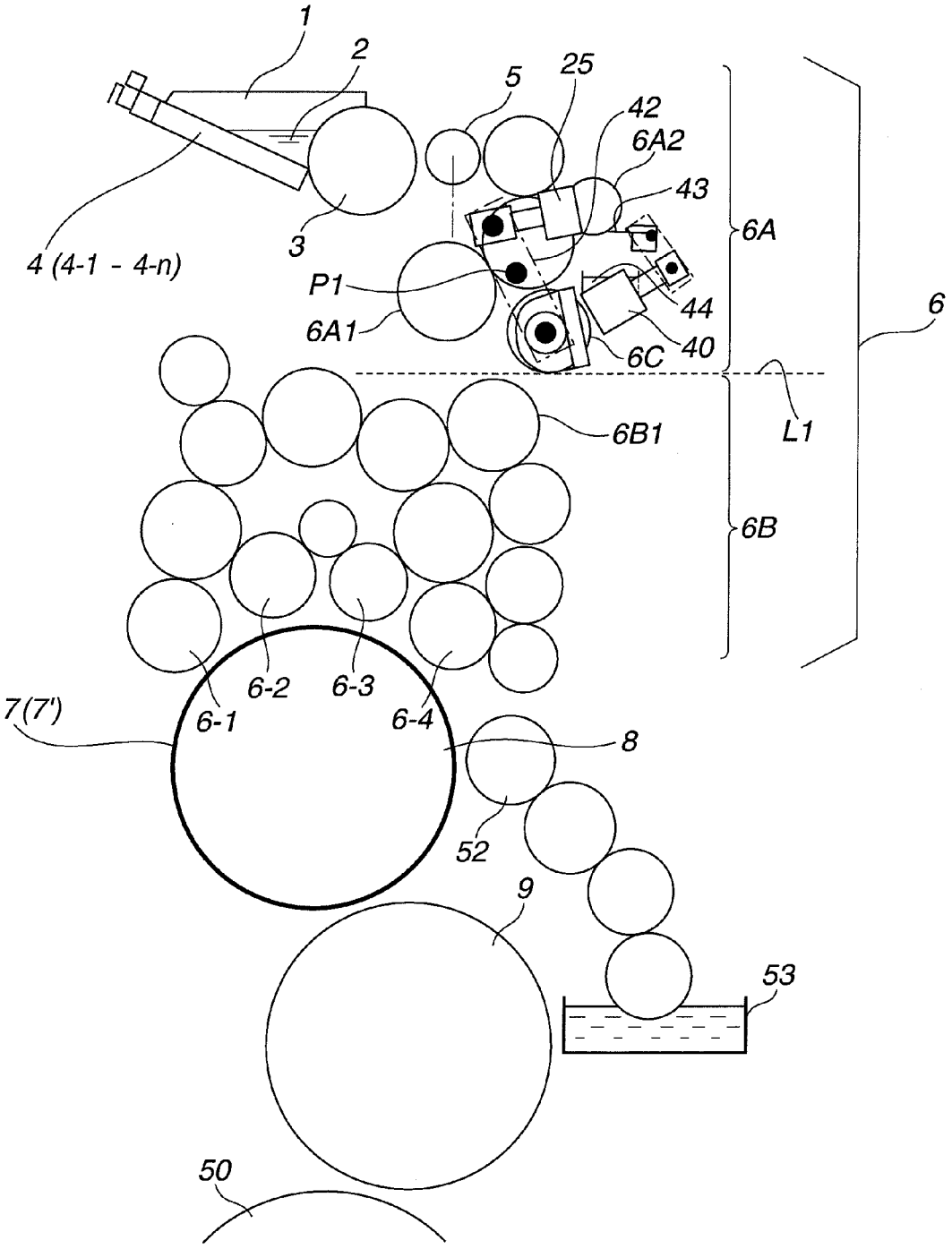
FIG. 4 is a view showing a state in which the ink roller group is divided and ink in an upstream roller subgroup is scraped by a blade in the ink supply apparatus in the printing unit to be controlled by the print job switching control apparatus shown in FIG. 1.

The CPU 10 reads out the printing speed Vp from the memory M5 (step S147), and outputs a rotation command to the motor driver 19 via the D/A converter 21 (step S148). In response to this, the printing press starts rotating, and its speed rises up to the printing speed Vp. The CPU 10 outputs a throw-on signal to the valve 41 (step S149), and the pneumatic cylinder 40 contracts, as shown in FIG. 4. The blade 43 comes into contact with the outer surface of the roller 6A2, starting scraping of ink (removal of ink) in the upstream roller subgroup 6A.

The CPU 10 keeps removing the ink in the upstream roller subgroup 6A until the number of revolutions of the printing press reaches the number N1 of revolutions in ink scraping in the memory M1. More specifically, the CPU 10 outputs a throw-on signal to the valve 41 (step S149), and outputs a reset signal and enable signal to the counter 23 (step S150). The CPU 10 then stops the output of the reset signal to the counter (step S151), and starts the count operation of the counter 23 from 0. The CPU 10 reads out the count value of the counter 23, and stores it in the memory M12 (step S152). The CPU 10 reads out the number N1 of revolutions in ink scraping from the memory M1 (step S153). The CPU 10 repeats the processing operations in steps S152 to S154 until the count value of the counter 23 reaches the number N1 of revolutions in ink scraping (YES in step S154).

Figure 9G:
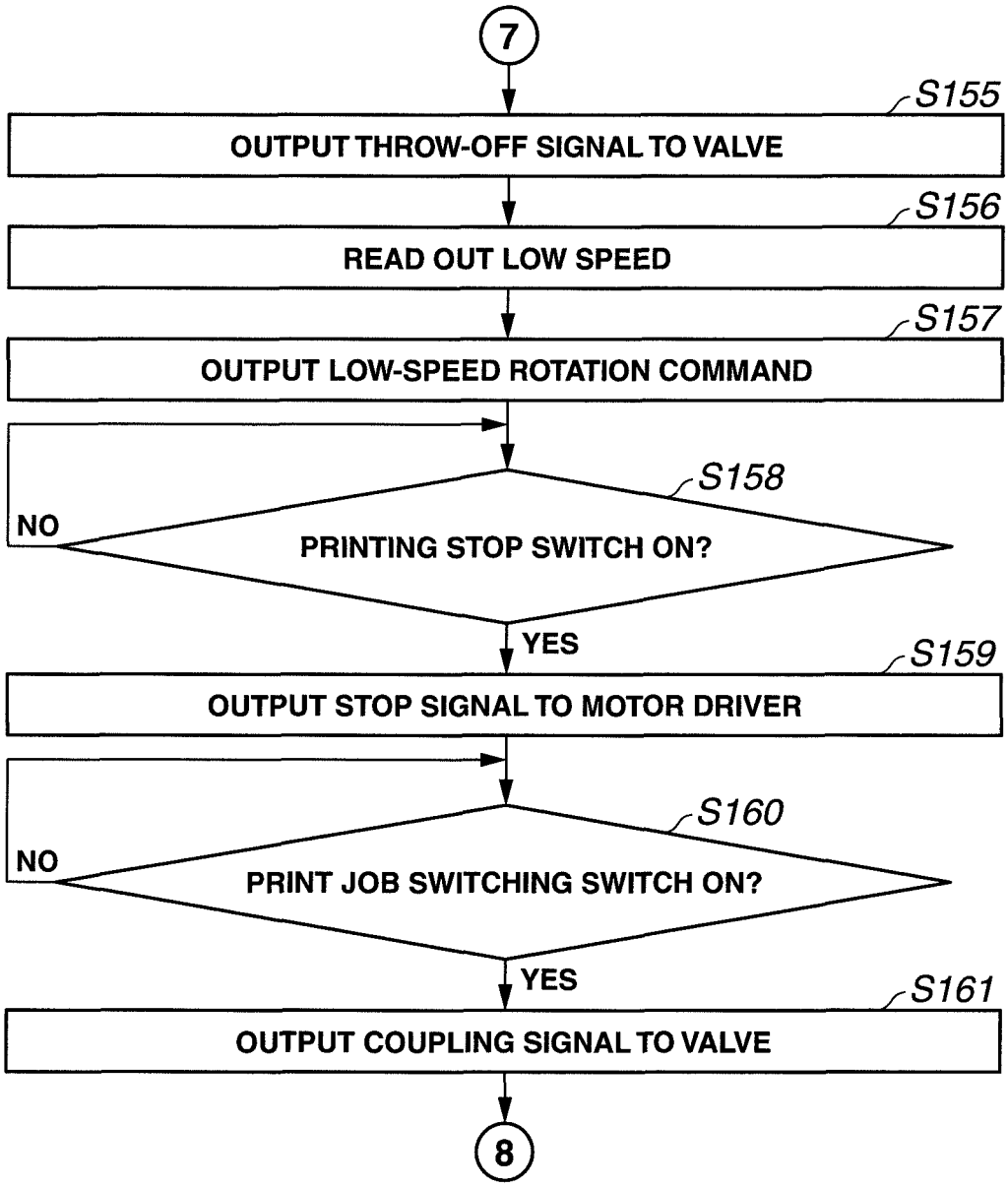

If the count value of the counter 23 reaches the number N1 of revolutions in ink scraping (YES in step S154), the CPU 10 outputs a throw-off signal to the valve 41 (FIG. 9G: step S155), completing the removal of the ink in the upstream roller subgroup 6A.

As shown in FIG. 6C, the ink film thickness distribution McA of the upstream roller subgroup 6A becomes almost 0. At this time, the ink film thickness distribution of the downstream roller subgroup 6B is leveled by the number N1 of revolutions in ink scraping, obtaining the flat ink film thickness distribution McB'.

Then, the CPU 10 reads out the low speed VL from the memory M13 (step S156), and outputs a rotation command to the motor driver 19 (step S157). In response to this, the printing press rotates at the low speed VL.

If the printing stop switch 16 has been turned on (YES in step S158), the CPU 10 outputs a stop signal to the motor driver 19 to stop the printing press.

[Plate Replacement & Cleaning]

While the printing press stops, and the ink form rollers 6-1 to 6-4 and the form dampening roller 52 are thrown off (FIG. 6C), the operator replaces the printing plate 7 mounted on the plate cylinder 8 with the printing plate 7' to be used for printing of the next job, and cleans the blanket cylinder 9 (FIG. 6D).

[Coupling of Ink Roller Group]

The operator turns on the print job switching switch 17 again. If the print job switching switch 17 has been turned on (YES in step S160), the CPU 10 outputs a coupling signal to the valve 26 (step S161) to couple the upstream roller subgroup 6A and downstream roller subgroup 6B and return them to the single ink roller group 6 (FIG. 6D).

[Pre-Inking in Ink Apparatus (Ink Film Thickness Distribution Forming Step)]

Figure 9H:
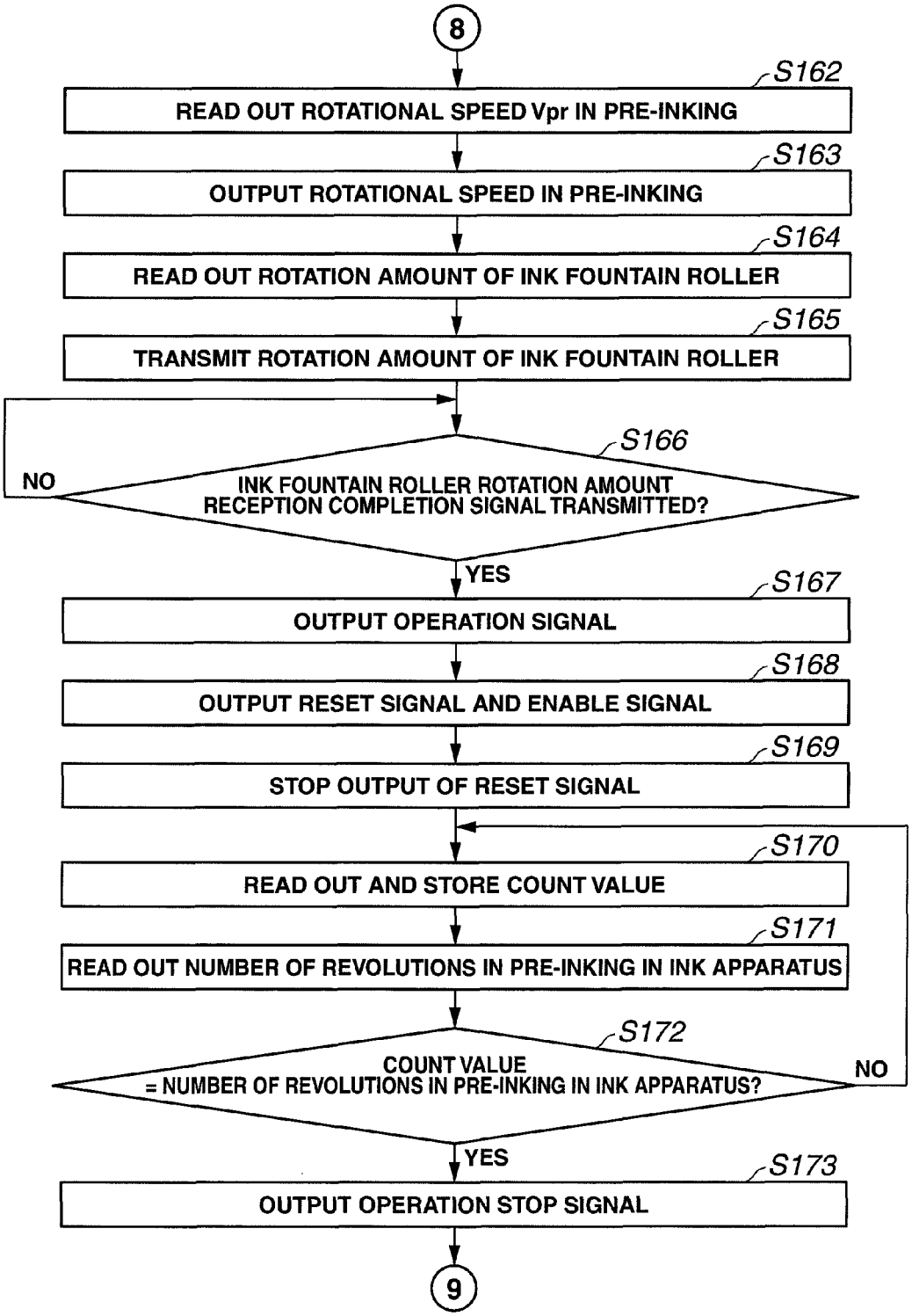

The CPU 10 reads out the rotational speed Vpr stored in the memory M4 (FIG. 9H: step S162), and outputs the readout rotational speed Vpr to the motor driver 19 (step S163). The CPU 10 reads out the rotation amount of the ink fountain roller that is stored in the memory M11 (step S164), and transmits the readout rotation amount of the ink fountain roller to the ink fountain roller control apparatus 200 (step S165).

If the CPU 10 receives an ink fountain roller rotation amount reception completion signal from the ink fountain roller control apparatus 200 (YES in step S166), it outputs an operation signal to the ink ductor device 24 (step S167), and starts the ink feed operation of the ink ductor roller 5. The ink feed operation of the ink ductor roller 5 continues until the number of revolutions of the printing press reaches the number N3 of revolutions in pre-inking in the ink apparatus that is stored in the memory M3 (steps S168 to S173).

More specifically, the CPU 10 outputs a reset signal and enable signal to the counter 23 (step S168), and stops the output of the reset signal to the counter 23 (step S169). In response to this, the count operation of the counter 23 starts from 0. The CPU 10 reads out the count value of the counter 23, stores it in the memory M12 (step S170), and reads out, from the memory M3, the number N3 of revolutions in pre-inking in the ink apparatus (step S171). The CPU 10 repeats the processing operations in steps S170 to S172 until the count value of the counter 23 reaches the number N3 of revolutions in pre-inking in the ink apparatus (YES in step S172).

As a result, the ink film thickness distribution Md in printing of the next job is formed in the ink roller group 6 (FIG. 6E).

[Division of Ink Roller Group (Roller Group Redivision Step)]

If the count value of the counter 23 reaches the number N3 of revolutions in pre-inking in the ink apparatus (YES in step S172), the CPU 10 outputs an operation stop signal to the ink ductor device 24 to stop the ink feed operation of the ink ductor roller 5 (step S173).

Figure 3:
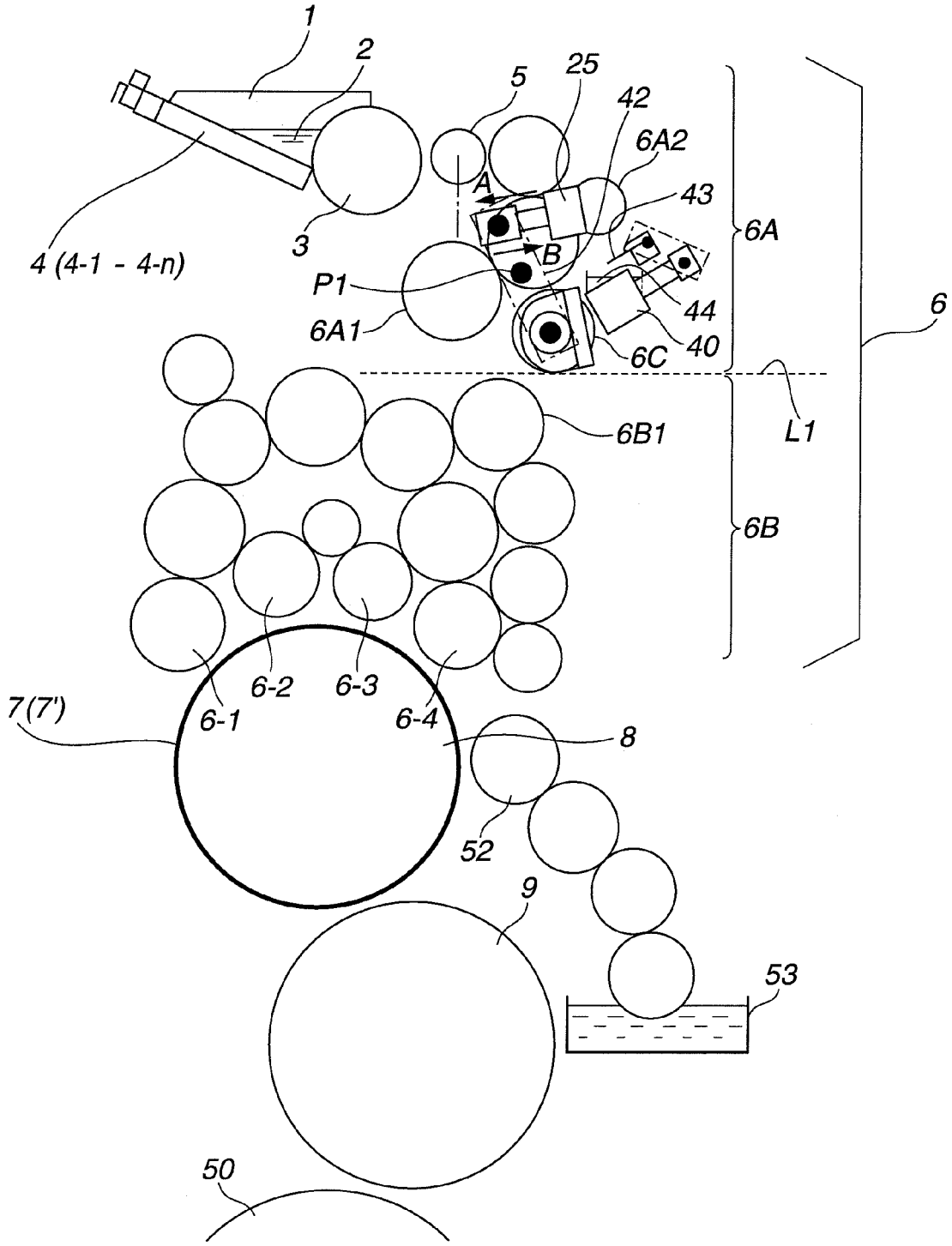
FIG. 3 is a view showing a state in which the ink roller group is divided in the ink supply apparatus in the printing unit to be controlled by the print job switching control apparatus shown in FIG. 1.
Figure 9I:
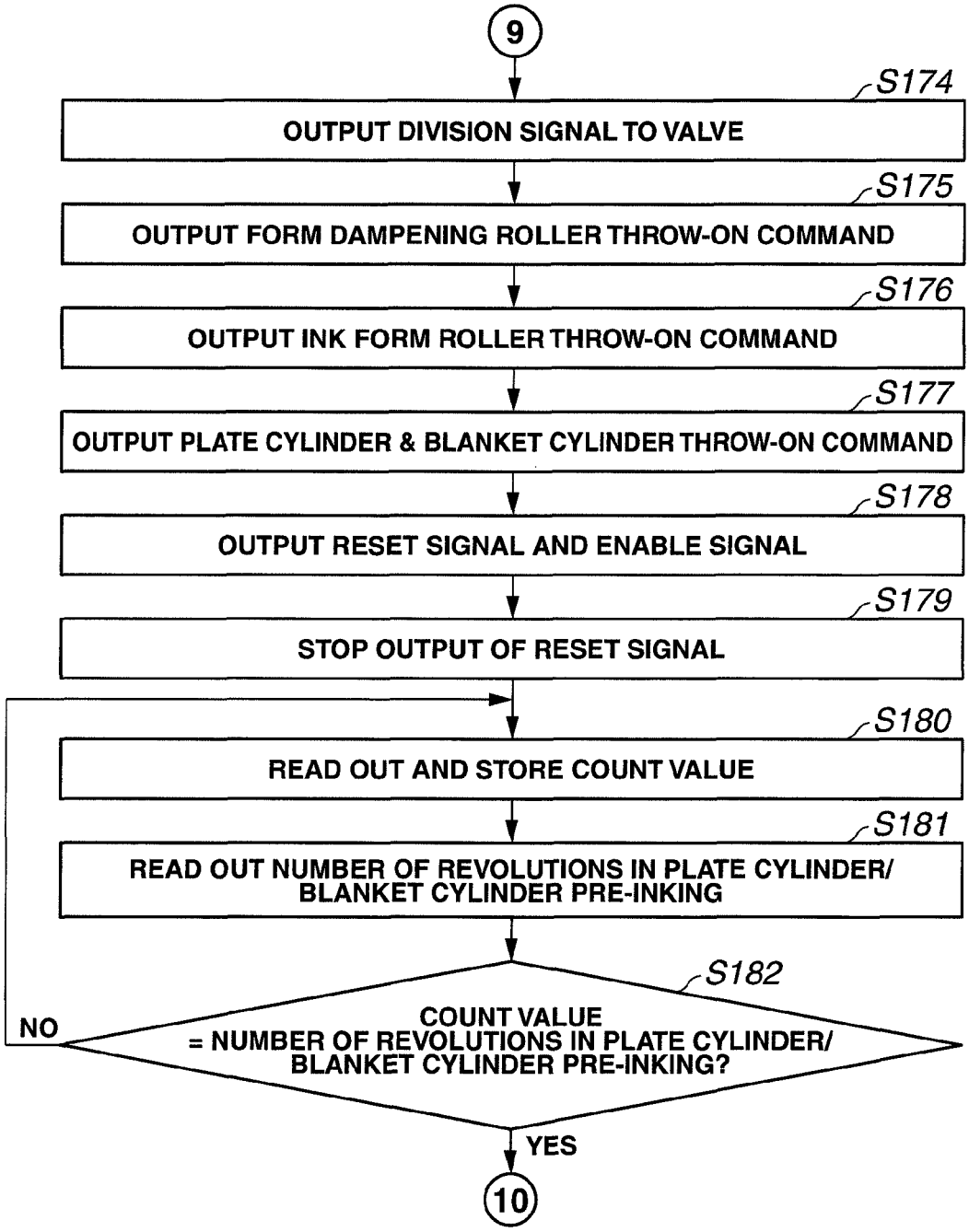

After that, the CPU 10 outputs a division signal to the valve 26 (FIG. 9I: step S174) to redivide the ink roller group 6 into the upstream roller subgroup 6A and downstream roller subgroup 6B (see FIG. 3).

As shown in FIG. 6F, the ink film thickness distribution Me of the ink roller group 6 is divided into the ink film thickness distribution MdA of the upstream roller subgroup 6A and the ink film thickness distribution MdB of the downstream roller subgroup 6B.

[Throw-on of Downstream Roller Subgroup, Plate Cylinder, and Blanket Cylinder (Throw-on Step)]

The CPU 10 outputs a form dampening roller throw-on command, ink form roller throw-on command, and plate cylinder & blanket cylinder throw-on command (steps S175, S176, and S177). By the form dampening roller throw-on command, the form dampening roller 52 is thrown on and contacts the printing plate 7'. By the ink form roller throw-on command, the ink form rollers 6-1 to 6-4 are thrown on and contact the printing plate 7'. By the plate cylinder & blanket cylinder throw-on command, only the plate cylinder 8 and blanket cylinder 9 are thrown on. That is, the blanket cylinder 9 is thrown only on the plate cylinder 8. Accordingly, the downstream roller subgroup 6B, plate cylinder 8, and blanket cylinder 9 are thrown on (FIG. 6G).

[Plate Cylinder/Blanket Cylinder Pre-Inking (Ink Supply Step)]

In this state, the CPU 10 rotates the printing press until the number of revolutions of the printing press reaches the number N2 of revolutions in plate cylinder/blanket cylinder pre-inking that is stored in the memory M2 (steps S178 to S182).

More specifically, the CPU 10 outputs a reset signal and enable signal to the counter 23 (step S178), stops the output of the reset signal to the counter 23 (step S179), and starts the count operation of the counter 23 from 0. The CPU 10 reads out the count value of the counter 23, and stores it in the memory M12 (step S180). The CPU 10 reads out, from the memory M2, the number N2 of revolutions in plate cylinder/blanket cylinder pre-inking (step S181). The CPU 10 repeats the processing operations in steps S180 to S182 until the count value of the counter 23 reaches the number N2 of revolutions in plate cylinder/blanket cylinder pre-inking (YES in step S182).

As a result, the ink in the downstream roller subgroup 6B is supplied to the printing plate 7' mounted on the plate cylinder 8, and the blanket cylinder 9 (FIG. 6H). In this case, only ink of the relatively thin ink film thickness distribution MdB in the downstream roller subgroup 6B is supplied to the printing plate 7' and blanket cylinder 9, preventing the ink film thickness distribution on the printing plate 7' and blanket cylinder 9 from becoming excessively thick.

[Printing of Next Job (Printing Start Step)] [Coupling of Ink Roller Group]

Figure 9J:
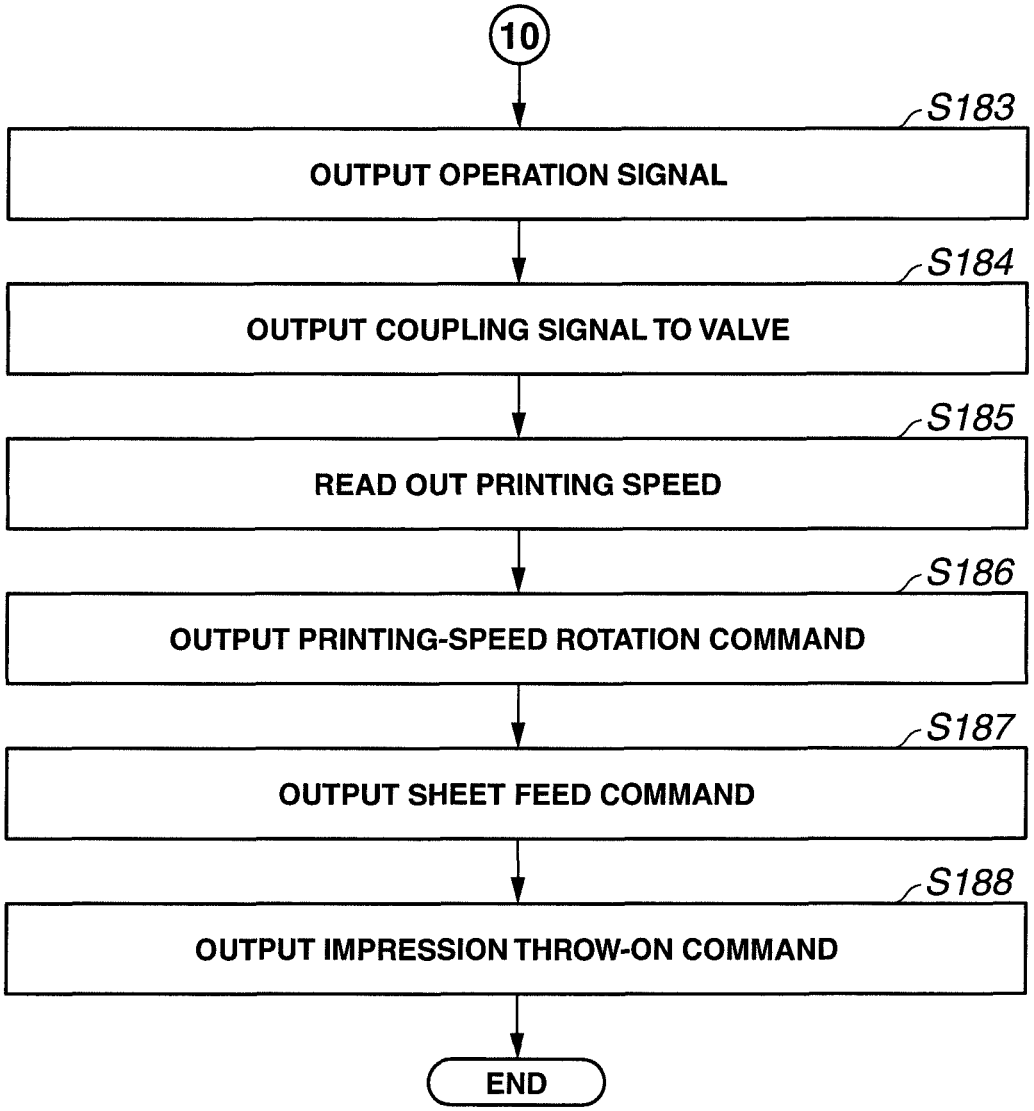

If the count value of the counter 23 reaches the number N2 of revolutions in plate cylinder/blanket cylinder pre-inking (YES in step S182), the CPU 10 outputs an operation signal to the ink ductor device 24 to start the ink feed operation of the ink ductor roller 5 (FIG. 9J: step S183).

The CPU 10 outputs a coupling signal to the valve 26 (step S184) to recouple the upstream roller subgroup 6A and downstream roller subgroup 6B (see FIG. 2), and return them to the single ink roller group 6 (FIG. 6I).

[Start of Printing]

The CPU 10 reads out the printing speed Vp from the memory M5 (step S185). The CPU 10 outputs a printing-speed rotation command to the motor driver 19 via the D/A converter 21 (step S186), and sets the printing speed Vp as the speed of the printing press. The CPU 10 outputs a sheet feed command to the sheet feeder 30 (step S187) to start sheet feed to the printing press. The CPU 10 outputs an impression throw-on command (plate cylinder & blanket cylinder throw-on command) (step S188) to throw the blanket cylinder 9 even on the impression cylinder 50. That is, the impression throw-on state in which the plate cylinder 8, blanket cylinder 9, and impression cylinder 50 contact each other is set (see FIG. 2). Then, printing of the next job starts using the printing plate 7'.

In this case, an ink film thickness distribution in printing of the next job (ink film thickness distribution in final printing) is formed during printing. At this time, the ink film thickness distribution MdB' in the downstream roller subgroup 6B and on the plate cylinder 8 and blanket cylinder 9 has become thin. Therefore, ink flows fast from the upstream side to the downstream side, quickly forming the ink film thickness distribution Me during final printing in the ink roller group 6 and on the plate cylinder 8 and blanket cylinder 9 (FIG. 6J).

In this manner, the embodiment prevents the ink film thickness distribution formed on the plate cylinder 8 and blanket cylinder 9 from becoming excessively thick. Ink flows fast from the upstream side to the downstream side, quickly forming an ink film thickness distribution during final printing in the ink roller group 6 and on the plate cylinder 8 and blanket cylinder 9. After the printing plate 7' is replaced and printing of the next job starts, a normal printing product can be obtained within a short time.

[Ink Fountain Roller Control Apparatus]

Figure 10:
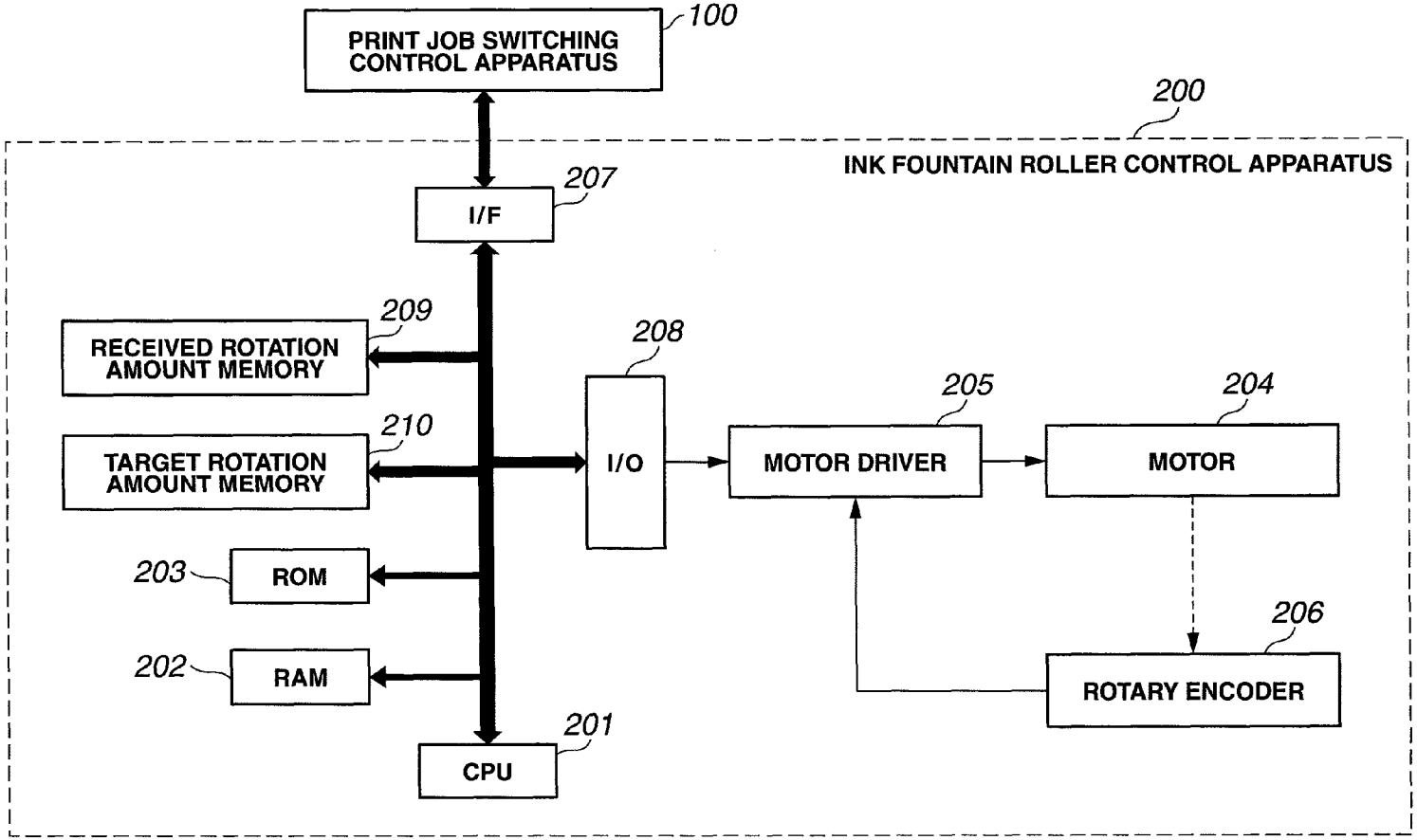
FIG. 10 is a block diagram showing the schematic arrangement of an ink fountain roller control apparatus shown in FIG. 1.

FIG. 10 shows the schematic internal arrangement of the ink fountain roller control apparatus 200. The ink fountain roller control apparatus 200 includes a CPU 201, a RAM 202, a ROM 203, an ink fountain roller driving motor 204, an ink fountain roller driving motor driver 205, an ink fountain roller driving motor rotary encoder 206, input/output interfaces (I/O I/Fs) 207 and 208, and memories 209 and 210. The ink fountain roller control apparatus 200 is connected to the print job switching control apparatus 100 via the interface 207. The memory 209 stores a received rotation amount of the ink fountain roller. The memory 210 stores the target rotation amount of the ink fountain roller.

Figure 11:
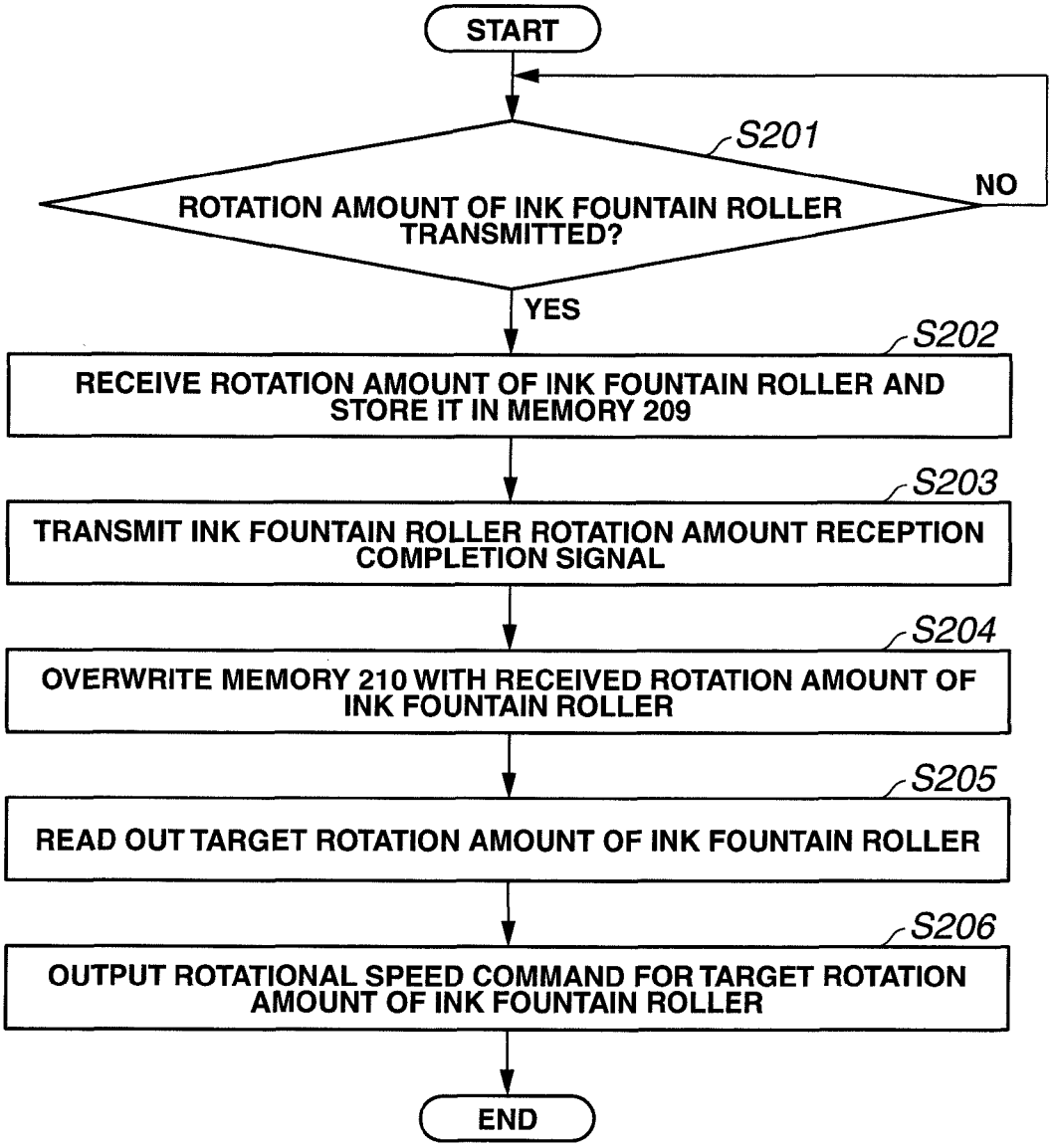
FIG. 11 is a flowchart showing the processing operation of the ink fountain roller control apparatus shown in FIG. 10.

If the print job switching control apparatus 100 has transmitted the rotation amount of the ink fountain roller (FIG. 11: YES in step S201), the CPU 201 stores the received rotation amount in the memory 209 (step S202). The CPU 201 then transmits an ink fountain roller rotation amount reception completion signal to the print job switching control apparatus 100 (step S203). The CPU 201 stores the received rotation amount of the ink fountain roller as the target rotation amount of the ink fountain roller in the memory 210 (step S204). The CPU 201 reads out the target rotation amount from the memory 210 (step S205), sends it to the ink fountain roller driving motor driver 205, and adjusts the rotation amount of the ink fountain roller driving motor 204 so that it coincides with the target rotation amount (step S206).

[Ink Fountain Key Control Apparatus]

Figure 12:
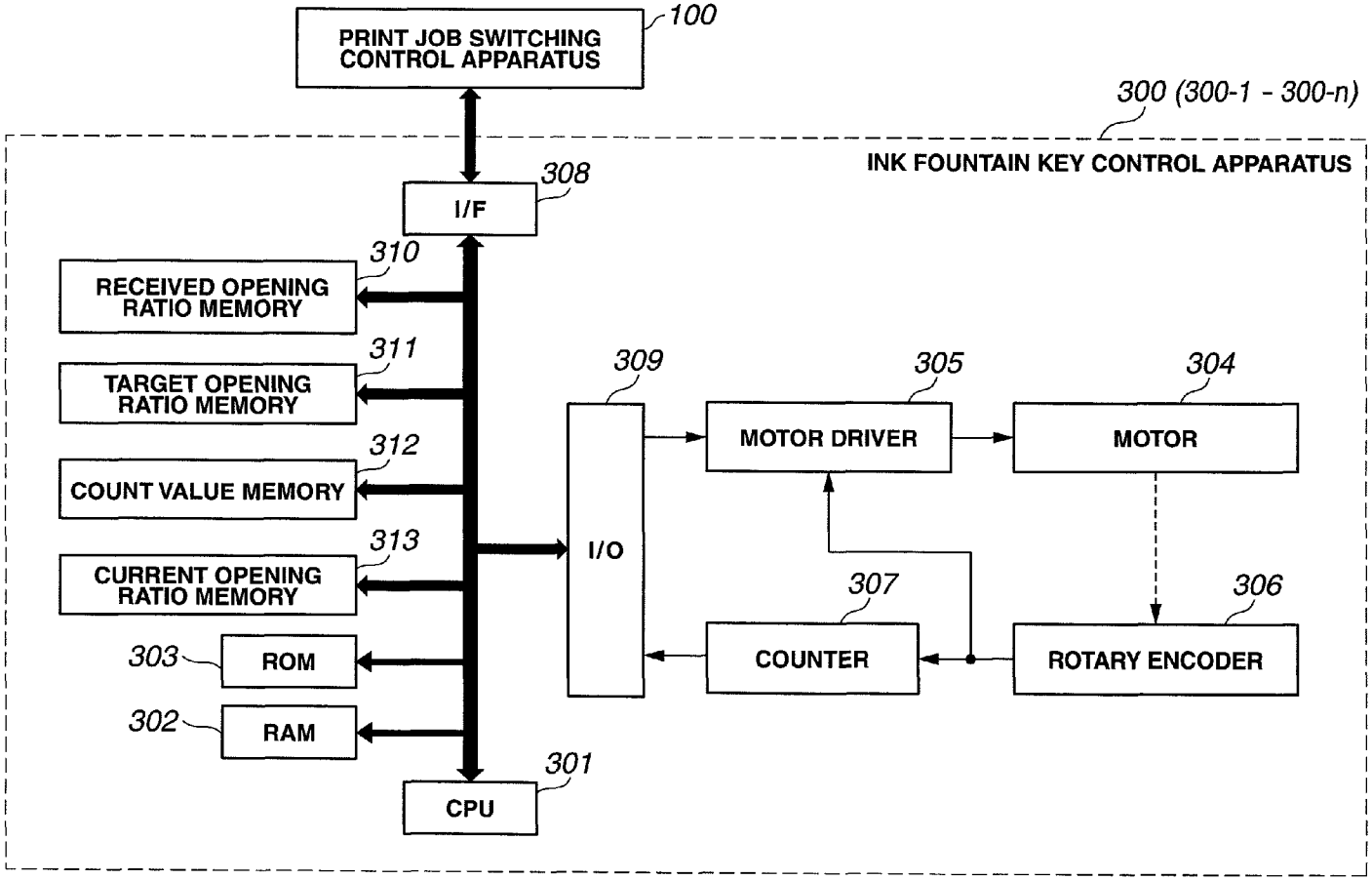
FIG. 12 is a block diagram showing the schematic arrangement of an ink fountain key control apparatus shown in FIG. 1.

FIG. 12 shows the schematic internal arrangement of the ink fountain key control apparatus 300 (300-1 to **300-*n*). The ink fountain key control apparatus 300 includes a CPU 301, a RAM 302, a ROM 303, an ink fountain key driving motor 304, an ink fountain key driving motor driver 305, an ink fountain key driving motor rotary encoder 306, a counter 307, input/output interfaces (I/O I/Fs) 308 and 309, and memories 310 to 313. The ink fountain key control apparatus 300 is connected to the print job switching control apparatus 100 via the interface 308. The memory 310 stores a received opening ratio of the ink fountain key. The memory 311 stores the target opening ratio of the ink fountain key. The memory 312 stores the count value of the counter 307. The memory 313** stores the current opening ratio of the ink fountain key.

Figure 13A:
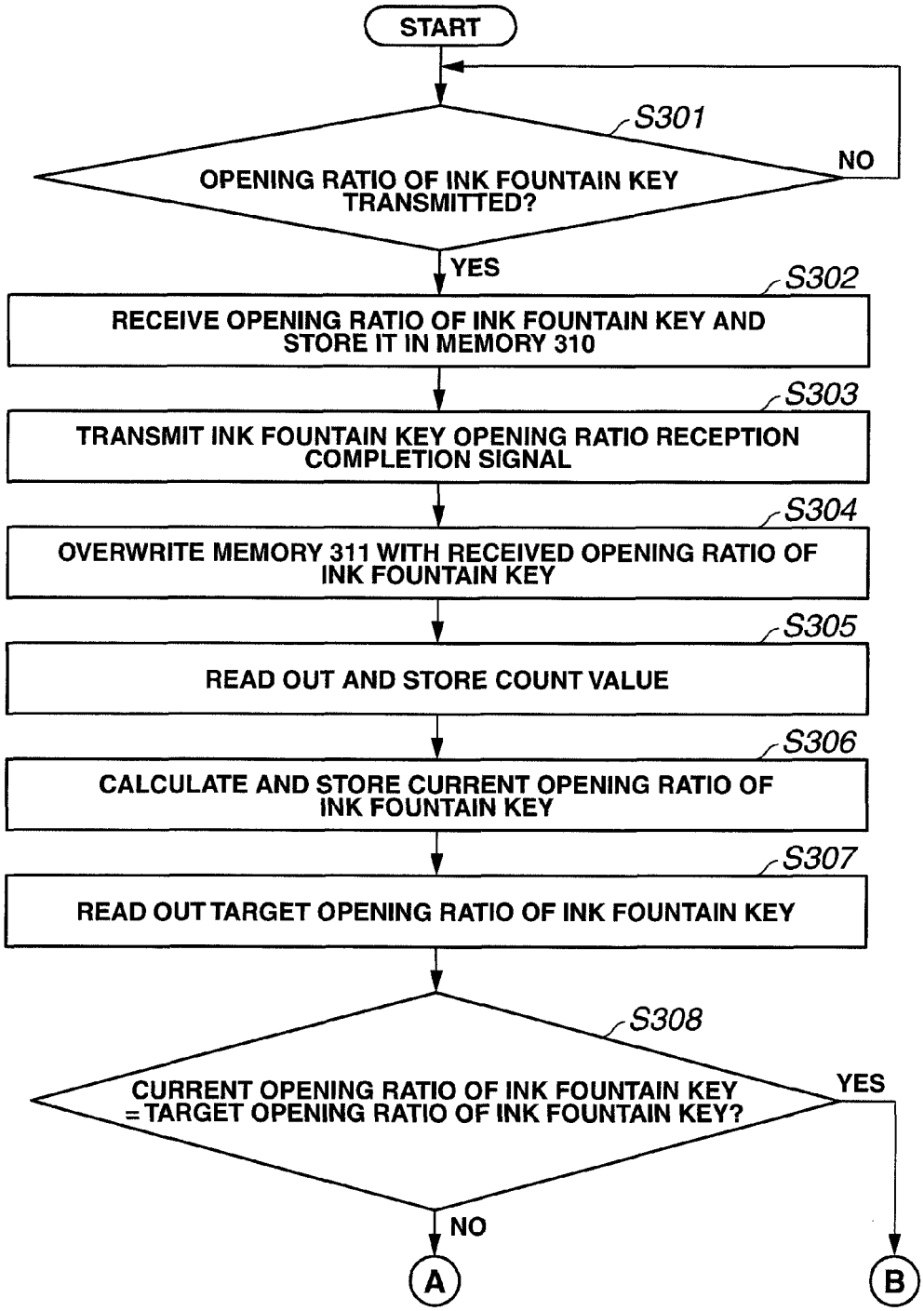
FIGS. 13A and 13B are flowcharts showing the processing operation of the ink fountain key control apparatus shown in FIG. 12.

If the print job switching control apparatus 100 has transmitted the opening ratio of the ink fountain roller (FIG. 13A: YES in step S301), the CPU 301 stores the received opening ratio in the memory 310 (step S302). The CPU 301 then transmits an ink fountain key opening ratio reception completion signal to the print job switching control apparatus 100 (step S303). The CPU 301 stores the received opening ratio of the ink fountain key as a target opening ratio in the memory 311 (step S304).

Figure 13B:
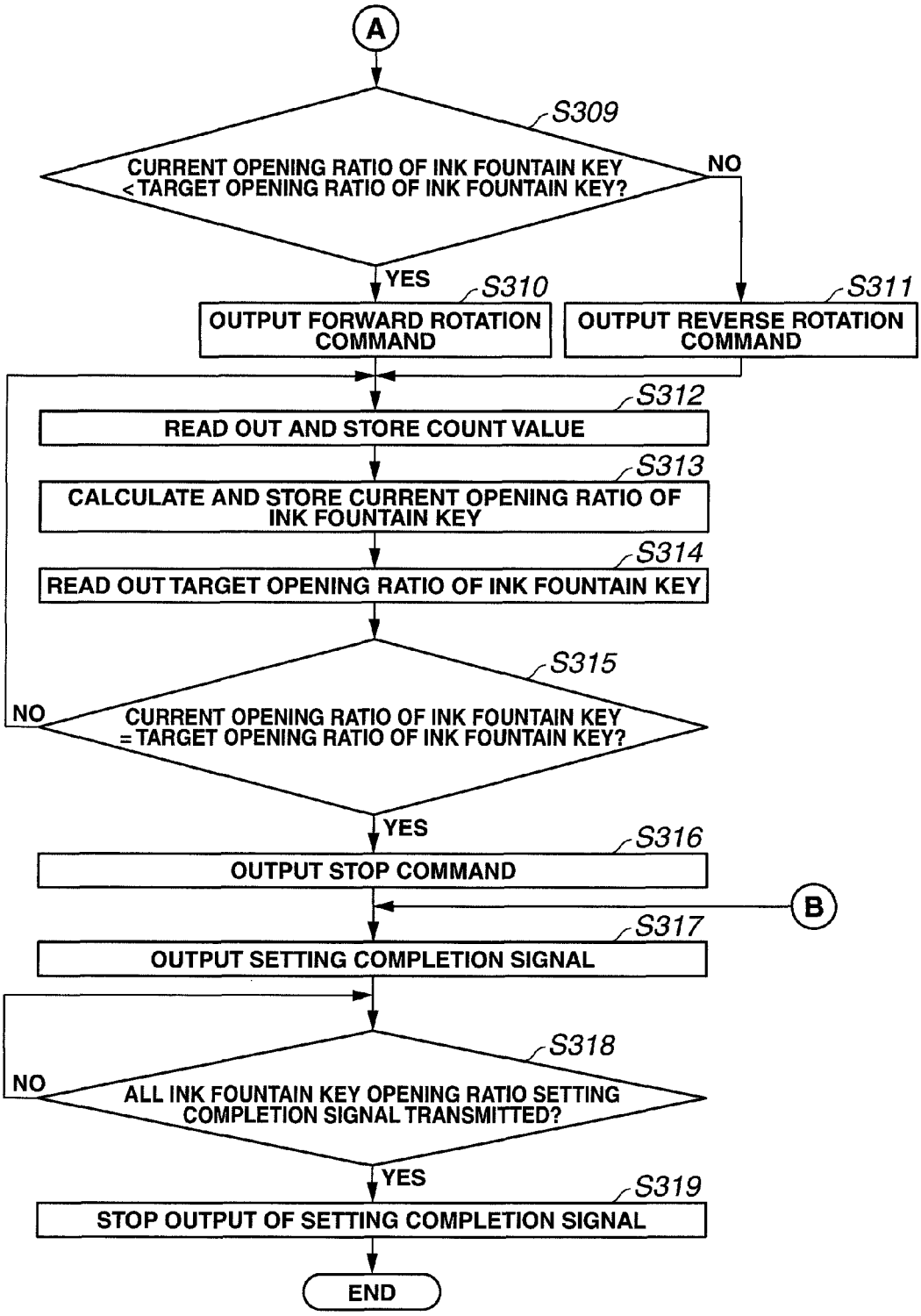

The CPU 301 reads the count value of the counter 307 and stores it in the memory 312 (step S305). The CPU 301 obtains the current opening ratio of the ink fountain key from the read count value of the counter 307, and stores it in the memory 313 (step S306). The CPU 301 reads out the target opening ratio of the ink fountain key from the memory 311 (step S307). If the current opening ratio of the ink fountain key is equal to the target opening ratio (YES in step S308), the process directly advances to step S317 (FIG. 13B). The CPU 301 outputs an ink fountain key opening ratio setting completion signal to the print job switching control apparatus 100.

If the current opening ratio of the ink fountain key is different from the target opening ratio (NO in step S308), the CPU 301 drives the ink fountain key driving motor 304 until the current opening ratio of the ink fountain key becomes equal to the target opening ratio (FIG. 13B: steps S309 to S316). After that, the CPU 301 outputs an ink fountain key opening ratio setting completion signal to the print job switching control apparatus 100 (step S317).

More specifically, if the current opening ratio of the ink fountain key is lower than the target opening ratio (YES in step S309), the CPU 301 sends a forward rotation command to the ink fountain key driving motor driver 305 (step S310). The CPU 301 reads out the count value from the counter 307 (step S312), and calculates the current opening ratio of the ink fountain key from the count value (step S313). The CPU 301 reads out the target opening ratio of the ink fountain key from the memory 311 (step S314). The CPU 301 repeats the processing operations in steps S312 to S315 until the current opening ratio of the ink fountain key coincides with the target opening ratio of the ink fountain key (YES in step S315).

If the current opening ratio of the ink fountain key is higher than the target opening ratio (NO in step S309), the CPU 301 sends a reverse rotation command to the ink fountain key driving motor driver 305 (step S311). The CPU 301 reads out the count value from the counter 307 (step S312), and calculates the current opening ratio of the ink fountain key from the count value (step S313). The CPU 301 reads out the target opening ratio of the ink fountain key from the memory 311 (step S314). The CPU 301 repeats the processing operations in steps S312 to S315 until the current opening ratio of the ink fountain key coincides with the target opening ratio of the ink fountain key (YES in step S315).

If the current opening ratio of the ink fountain key coincides with the target opening ratio of the ink fountain key in step S315 (YES in step S315), the CPU 301 outputs a stop command to the ink fountain key driving motor driver 305 (step S316), and outputs an ink fountain key opening ratio setting completion signal to the print job switching control apparatus 100 (step S317).

After outputting the ink fountain key opening ratio setting completion signal to the print job switching control apparatus 100 (step S317), the CPU 301 stops the output of the ink fountain key opening ratio setting completion signal to the print job switching control apparatus 100 (step S319) upon receiving an all ink fountain key opening ratio setting completion signal from the print job switching control apparatus 100 (YES in step S318).

In the above-described embodiment, the ink roller group 6 is divided into the two, upstream roller subgroup 6A and downstream roller subgroup 6B (strictly speaking, into three, including the roller 6C). However, the ink roller group 6 may be divided into a larger number of subgroups such as three or four. In this case, it suffices to throw the most downstream roller subgroup out of the divided roller subgroups on the plate cylinder on which a printing plate to be used for printing of the next job is mounted.

In the above-described embodiment, the ink roller group 6 is divided and coupled using the swing arm 42. However, the mechanism of dividing and coupling the ink roller group 6 is not limited to the mechanism using the swing arm.

Figure 14:
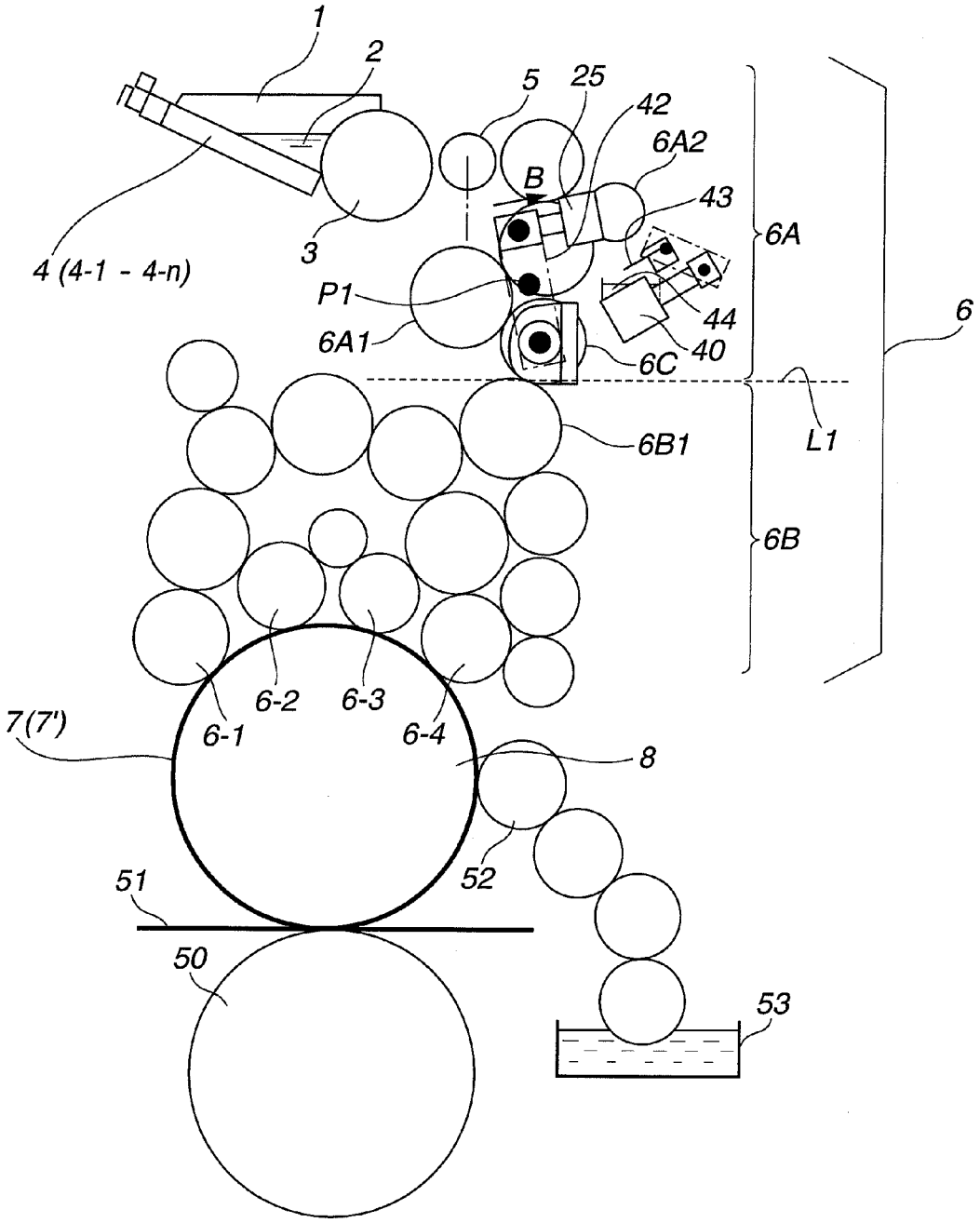
FIG. 14 is a view showing an example in which ink supplied to a printing plate mounted on the plate cylinder is directly transferred to a printing sheet without the mediacy of the blanket cylinder.

The above-described embodiment has explained an example in which ink supplied to the printing plate 7 (7') mounted on the plate cylinder 8 is transferred to the printing sheet 51 via the blanket cylinder 9. However, the present invention is similarly applicable to an example (see FIG. 14) in which ink supplied to the printing plate 7 (7') mounted on the plate cylinder 8 is directly transferred to the printing sheet 51 without the mediacy of the blanket cylinder 9. Even in this case, the same effects as those described above can be obtained.

As described above, according to the present invention, after the end of a print job using a preceding printing plate (after the end of a preceding print job), the ink roller group is divided into a plurality of roller subgroups while the ink form rollers are thrown off and the ink feed operation of the ink ductor roller is stopped. Then, ink in some of the divided roller subgroups is scraped and removed by a blade or scraper. Although the ink roller group is divided into a plurality of roller subgroups, the number of roller subgroups is arbitrary such as two or more. Although ink in some of the divided roller subgroups is removed, ink may be removed from a plurality of roller subgroups.

In the present invention, in an arrangement capable of dividing the ink roller group into two roller subgroups, the ink roller group is divided into upstream and downstream roller subgroups. Ink is removed from some of the divided roller subgroups, e.g., the upstream roller subgroup. In this case, the ink in the upstream roller subgroup cannot be returned to the ink fountain because the ink feed operation of the ink ductor roller stops. Since the upstream roller subgroup is disconnected from the downstream roller subgroup, the ink cannot be removed even by blank sheet printing. In the present invention, therefore, the ink in the upstream roller subgroup is scraped using the blade or scraper, instead of removing it by "ink return to fountain" or blank sheet printing.

In the present invention, the ink feed operation of the ink ductor roller is performed by a predetermined number of times while the upstream and downstream roller subgroups are coupled and returned to the single ink roller group and the opening ratio of each ink fountain key is set to be a value corresponding to an image on a printing plate to be used for printing of the next job. Hence, an ink film thickness distribution corresponding to the image on the printing plate to be used for printing of the next job is formed in the single returned ink roller group.

According to the present invention, an ink film thickness distribution corresponding to an image on a printing plate to be used for printing of the next job is formed in the ink roller group. Then, the ink roller group in which the ink film thickness distribution corresponding to the image on the printing plate to be used for printing of the next job is formed is divided into a plurality of roller subgroups. After or before division, at least a roller subgroup on the most downstream side out of the plurality of roller subgroups is thrown on the plate cylinder on which the printing plate to be used for printing of the next job is mounted. More specifically, after division into a plurality of roller subgroups, at least a roller subgroup on the most downstream side out of the plurality of divided roller subgroups is thrown on the plate cylinder. Alternatively, after a roller subgroup on the most downstream side out of a plurality of roller subgroups is thrown on the plate cylinder, the ink roller group is divided into a plurality of roller subgroups. The plate cylinder and roller subgroup in the throw-on state after division are rotated by a predetermined number of revolutions, and ink in the roller subgroup is supplied to a printing plate mounted on the plate cylinder.

In the present invention, in an arrangement capable of dividing the ink roller group into two roller subgroups, the ink roller group is divided into upstream and downstream roller subgroups. After or before division, the downstream roller subgroup is thrown on the plate cylinder. The plate cylinder and downstream roller subgroup in the throw-on state after division are rotated by a predetermined number of revolutions, and ink in the downstream roller subgroup is supplied to a printing plate mounted on the plate cylinder. In this case, only ink of a relatively thin ink film thickness distribution in the downstream roller subgroup is supplied to the printing plate, preventing the ink film thickness distribution on the plate cylinder from becoming excessively thick.

In the ink film thickness control method disclosed in literature 1 or 2, an ink film thickness distribution corresponding to an image on a printing plate for the next print job is superposed on a minimum ink film thickness distribution which is formed in the ink roller group and required during printing. After that, the ink form rollers are thrown on, and printing starts by supplying ink in the ink roller group to the replaced printing plate for the next print job and the cleaned blanket cylinder. Thus, printing for the next job starts from a state in which no ink remains on the plate cylinder and blanket cylinder. No proper printing product can be printed until an ink film thickness distribution for final printing is formed during printing on the plate cylinder and blanket cylinder and in the ink roller group. Many sheets are wasted, wasting printing materials.

There is another ink film thickness control method, as disclosed in Japanese Patent Laid-Open No. 3-97564 (literature 3). In this method, an ink film thickness distribution corresponding to an image on a printing plate for the next print job is superposed on a minimum ink film thickness distribution which is formed in the ink roller group and required during printing. Before the start of printing of the next job, the ink form rollers, form dampening roller, plate cylinder, and blanket cylinder are brought into contact with each other. In this state, the printing press is rotated by a predetermined number of times, supplying ink to even the plate cylinder and blanket cylinder. However, according to the method disclosed in literature 3, all ink in the ink supply apparatus is leveled in the ink roller group and on the plate cylinder and blanket cylinder. An excessively large amount of ink is supplied to the plate cylinder and blanket cylinder, and the ink film thickness distribution on the plate cylinder and blanket cylinder becomes excessively thick. For this reason, many sheets are wasted until the excessively large amount of supplied ink is consumed.

However, the present invention does not cause any of the above-described problems because only ink of a relatively thin ink film thickness distribution in the downstream roller subgroup is supplied to the printing plate.

In the present invention, ink supplied to a printing plate mounted on the plate cylinder can also be directly transferred to a printing member without the mediacy of the blanket cylinder. When transferring ink via the blanket cylinder, only ink of a relatively thin ink film thickness distribution in the downstream roller subgroup is supplied to the printing plate and blanket cylinder, preventing the ink film thickness distribution on the plate cylinder and blanket cylinder from becoming excessively thick.

In the present invention, ink in the downstream roller subgroup is supplied to form an ink film thickness distribution on the plate cylinder (or the plate cylinder and blanket cylinder). Then, the upstream and downstream roller subgroups are coupled and returned to the single roller group, and printing of the next job starts. In this case, an ink film thickness distribution in printing of the next job (ink film thickness distribution in final printing) is formed during printing. At this time, an ink film thickness distribution in the downstream roller subgroup and on the plate cylinder (or the plate cylinder and blanket cylinder) has become thin. Thus, ink flows fast from the upstream side to the downstream side, quickly forming an ink film thickness distribution during final printing in the ink roller group and on the plate cylinder (or the plate cylinder and blanket cylinder).

What is claimed is:

1. An ink supply method in an ink supply apparatus including an ink fountain storing an ink, a plurality of ink fountain keys arranged in the ink fountain, an ink fountain roller to which the ink is supplied from the ink fountain in accordance with opening ratios of the plurality of ink fountain keys, an ink ductor roller to which the ink is transferred from the ink fountain roller by an ink feed operation, and an ink roller group to which the ink transferred to the ink ductor roller is supplied, comprising the steps of:

performing a throw-off operation of an ink form roller positioned at an end of the ink roller group after an end of a print job using a preceding printing plate;

stopping the ink feed operation of the ink ductor roller after the end of the print job using the preceding printing plate;

dividing the ink roller group into a plurality of roller subgroups after the end of the print job using the preceding printing plate; and scraping and removing the ink in some roller subgroups out of the divided roller subgroups by an ink scraping member.

2. A method according to claim 1, further comprising the steps of:

coupling the plurality of divided roller subgroups to return the plurality of divided roller subgroups to the single ink roller group after removing the ink in some roller subgroups;

setting the opening ratios of the plurality of ink fountain keys to be values corresponding to an image on a printing plate to be used for printing of a next job; and after returning the roller subgroups to the single ink roller group and setting the opening ratios of the ink fountain keys to be values corresponding to the image on the printing plate to be used for printing of the next job, forming an ink film thickness distribution corresponding to the image on the printing plate to be used for printing of the next job in the single returned ink roller group by performing the ink feed operation of the ink ductor roller by a predetermined number of times.

3. A method according to claim 2, further comprising the steps of:

redividing, into the plurality of roller subgroups, the single ink roller group in which the ink film thickness distribution corresponding to the image on the printing plate to be used for printing of the next job is formed;

after or before redivision, performing a throw-on operation for a plate cylinder on which the printing plate to be used for printing of the next job is mounted, and a roller subgroup positioned on a most downstream side out of the plurality of roller subgroups; and after the redivision operation and after the throw-on operation, supplying ink in the roller subgroup to at least the printing plate mounted on the plate cylinder by rotating the plate cylinder and the roller subgroup by a predetermined number of revolutions.

4. A method according to claim 3, further comprising the step of, after or before redivision, performing the throw-on operation for the plate cylinder on which the printing plate to be used for printing of the next job is mounted, and a blanket cylinder on which the ink on the printing plate mounted on the plate cylinder is transferred to a printing member, wherein the step of supplying ink comprises the step of, after the redivision operation and after the throw-on operation, supplying the ink in the roller subgroup to the printing plate mounted on the plate cylinder and the blanket cylinder by rotating the plate cylinder, the roller subgroup, and the blanket cylinder by a predetermined number of revolutions.

5. A method according to claim 3, further comprising the step of, after supplying the ink in the roller subgroup to the printing plate mounted on the plate cylinder, recoupling the plurality of redivided roller subgroups to return the plurality of redivided roller subgroups to the single ink roller group, and starting printing of the next job using the printing plate mounted on the plate cylinder.

* * * * *